US009490541B2

(12) United States Patent
Tayama et al.

(10) Patent No.: US 9,490,541 B2
(45) Date of Patent: Nov. 8, 2016

(54) LOOP ANTENNA

(71) Applicant: FUJIKURA LTD., Tokyo (JP)

(72) Inventors: Hiroiku Tayama, Sakura (JP); Ning Guan, Sakura (JP); Yuichiro Yamaguchi, Sakura (JP); Takeshi Togura, Sakura (JP); Hiroshi Chiba, Tokyo (JP)

(73) Assignee: FUJIKURA LTD., Tokyo (JP)

( * ) Notice: Subject to any disclaimer, the term of this patent is extended or adjusted under 35 U.S.C. 154(b) by 149 days.

(21) Appl. No.: 14/462,962

(22) Filed: Aug. 19, 2014

(65) Prior Publication Data

US 2014/0354509 A1 Dec. 4, 2014

Related U.S. Application Data

(63) Continuation of application No. PCT/JP2013/054276, filed on Feb. 21, 2013.

(30) Foreign Application Priority Data

Feb. 21, 2012 (JP) ..... 2012-035618
Jun. 29, 2012 (JP) ..... 2012-147988

(51) Int. Cl.
*H01Q 7/00* (2006.01)
*H01Q 9/06* (2006.01)
(Continued)

(52) U.S. Cl.
CPC ..... *H01Q 9/065* (2013.01); *H01Q 1/38* (2013.01); *H01Q 5/357* (2015.01); *H01Q 7/00* (2013.01); *H01Q 9/27* (2013.01); *H01Q 21/0006* (2013.01)

(58) Field of Classification Search
CPC ..... H01Q 7/00; H01Q 9/27; H01Q 5/357
USPC ..... 343/741, 866
See application file for complete search history.

(56) References Cited

U.S. PATENT DOCUMENTS 2,324,462 A * 7/1943 Leeds ..... H01Q 9/26 343/742
4,595,928 A * 6/1986 Wingard ..... H01Q 7/00 343/742

(Continued)

FOREIGN PATENT DOCUMENTS

CN 201117820 Y 9/2008
CN 101656347 A 2/2010

(Continued)

OTHER PUBLICATIONS

Office Action dated Jun. 25, 2015, issued in counterpart Chinese application No. 201380010165.0 (8 pages).

(Continued)

*Primary Examiner* — Tho G Phan
(74) *Attorney, Agent, or Firm* — Westerman, Hattori, Daniels & Adrian, LLP

(57) ABSTRACT

A loop antenna in accordance with the present invention has an antenna element having a shape that traces a closed curve, the antenna element including (i) a first projection section which projects from one of two end sections of the antenna element toward an inside of the closed curve and (ii) a second projection section which projects from the other of the two end sections of the antenna element toward the inside of the closed curve, each of the first projection section and the second projection section including a feed point.

12 Claims, 18 Drawing Sheets

(51) Int. Cl.

| | |
|---|---|
| ***H01Q 9/27*** | (2006.01) |
| ***H01Q 1/38*** | (2006.01) |
| ***H01Q 21/00*** | (2006.01) |
| ***H01Q 5/357*** | (2015.01) |

(56) References Cited

U.S. PATENT DOCUMENTS

| | | | | |
|---|---|---|---|---|
| 5,371,509 | A * | 12/1994 | Wallace, Jr. | H01Q 7/00 343/700 MS |
| 5,838,283 | A * | 11/1998 | Nakano | H01Q 7/00 343/741 |
| 6,342,862 | B1 * | 1/2002 | Schoenthal | H01Q 9/26 343/741 |
| 6,396,447 | B1 | 5/2002 | Jonasson | |
| 6,597,318 | B1 | 7/2003 | Parsche et al. | |
| 7,057,574 | B2 * | 6/2006 | Shamir | H01Q 1/36 343/748 |
| 2005/0001026 | A1 | 1/2005 | Maeda et al. | |
| 2007/0120756 | A1 | 5/2007 | Ogino et al. | |
| 2009/0322634 | A1 | 12/2009 | Yun et al. | |
| 2010/0164816 | A1 | 7/2010 | Kuribayashi et al. | |
| 2011/0037673 | A1 | 2/2011 | Huang | |

FOREIGN PATENT DOCUMENTS

| | | | |
|---|---|---|---|
| CN | 101997165 | A | 3/2011 |
| JP | 4-19814 | U | 2/1992 |
| JP | 2005-347799 | A | 12/2005 |
| JP | 2007-158957 | A | 6/2007 |
| JP | 2008-153738 | A | 7/2008 |
| JP | 4198090 | B | 12/2008 |
| JP | 2009-17116 | A | 1/2009 |
| JP | 2009-267765 | A | 11/2009 |
| JP | 2010-81500 | A | 4/2010 |
| JP | 2011-101412 | A | 5/2011 |

OTHER PUBLICATIONS

International Search Report dated May 21, 2013 issued in corresponding application No. PCT/JP2013/054276.

Japanese Office Action dated Jul. 1, 2014, issued in corresponding Japanese Application No. 2014-102694; w/ partial English translation.

Notification of Transmittal of Translation of the International Preliminary Report on Patentability (Chapter I or Chapeter II) (Form PCT/IB/338) of International Application No. PCT/JP2013/054276 mailed Sep. 4, 2014 with forms PCT/IB/373 and PCT/ISA/237. (6 pages).

Extended European Search Report dated Feb. 23, 2015, issued in corresponding European Patent Application No. 13751111.9 (6 pages).

* cited by examiner

LOOP ANTENNA

CROSS-REFERENCE TO RELATED APPLICATIONS

This application is a Continuation of PCT International Application No. PCT/JP 2013/054276 filed in Japan on Feb. 21, 2013, which claims the benefit of Patent Application No. 2012-035618 filed in Japan on Feb. 21, 2012 and Patent Application No. 2012-147988 filed in Japan on Jun. 29, 2012, the entire contents of which are hereby incorporated by reference.

TECHNICAL FIELD

The present invention relates to a loop antenna.

BACKGROUND ART

An antenna has been used since a long time ago as a device for converting a high-frequency current into an electromagnetic wave or converting an electromagnetic wave to a high-frequency current. An antenna is classified into a linear antenna, a planar antenna, a solid antenna, and the like according to its shape, or is classified into a dipole antenna, a monopole antenna, a loop antenna, and the like according to its structure. In particular, a loop antenna has a simple structure constituted by a single annular antenna element, and is one of antennas that are widely used to this date.

In response to diversified use of wireless communications, these antennas are expected to operate in various frequency bands. For example, a vehicle-mounted antenna is expected to operate in frequency bands for FM/AM broadcast, terrestrial digital broadcasting such as DAB (Digital Audio Broadcast), 3G (3rd Generation), LTE (Long Term Evolution), GPS (Global Positioning System), VICS® (Vehicle Information and Communication System), ETC (Electronic Toll Collection), and the like.

Conventionally, an antenna for operation in different frequency bands is often realized in the form of separate antenna devices which operate in the respective different frequency bands. For example, an antenna for FM/AM broadcast is provided as a whip antenna to be placed on a rooftop, and an antenna for terrestrial digital broadcasting is provided as a film antenna to be attached to a windshield.

However, an automobile has limited portions to which an antenna device can be attached. Further, an increase in the number of antenna devices to be attached results in problems such as spoiled design and increased attachment costs. To prevent such problems, it is effective to use an integrated antenna device. Note that the integrated antenna device refers to an antenna device which includes a plurality of antennas that operate in respective different frequency bands.

Examples of the integrated antenna device include ones described in Patent Literature 1 through 5. The integrated antenna device described in Patent Literature 1 includes an antenna for GPS and an antenna for ETC. The integrated antenna device described in Patent Literature 2 includes an antenna for 3G and an antenna for GPS. The integrated antenna described in Patent Literature 3 includes an antenna for ETC, an antenna for GPS, an antenna for VICS, a main antenna for telephone, and an auxiliary antenna for telephone. The integrated antenna device described in Patent Literature 4 includes an antenna for GPS, an antenna for ETC, an antenna for a first telephone, and an antenna for a second telephone. The integrated antenna device described in Patent Literature 5 includes an antenna that operates in a band of not lower than 100 kHz but not higher than 1 GHz (FM/AM broadcast, terrestrial digital broadcasting such as DAB, VICS, and the like), and an antenna that operates in a band of not lower than 1 GHz (GPS, satellite DAB, and the like).

CITATION LIST

Patent Literature

[Patent Literature 1]
Japanese Patent Application Publication, Tokukai, No. 2007-158957 A (Publication Date: Jun. 21, 2007)
[Patent Literature 2]
Japanese Patent Application Publication, Tokukai, No. 2009-17116 A (Publication Date: Jan. 22, 2009)
[Patent Literature 3]
Japanese Patent Application Publication, Tokukai, No. 2009-267765 A (Publication Date: Nov. 12, 2009)
[Patent Literature 4]
Japanese Patent Application Publication, Tokukai, No. 2010-81500 A (Publication Date: Apr. 8, 2010)
[Patent Literature 5]
U.S. Pat. No. 6,396,447 [Registration Date: May 28, 2002]

SUMMARY OF INVENTION

Technical Problem

However, a conventional loop antenna has a problem that reduction in size of the loop antenna is difficult. In fact, in order to transmit or receive an electromagnetic wave with a wavelength λ by use of a loop antenna, it is necessary that a total length of the antenna element be approximately λ. For example, in order to receive a GPS wave (1575.42 MHZ) by use of a loop antenna, a total length of the antenna element needs to be approximately 20 cm.

Further, in order to provide a loop antenna which is suitably mounted in an integrated antenna device, it is also necessary to take account of the following problems of a conventional integrated antenna device.

That is, in a conventional integrated antenna device, antenna elements constituting respective antennas are disposed so as not to overlap each other. This results in a problem that reduction in size of the integrated antenna device is difficult. Note that the purpose of employing a configuration in which the antenna elements constituting the respective antennas are disposed so as not to overlap each other is to prevent an antenna characteristic of each antenna from being impaired by the presence of another antenna.

For example, the integrated antenna device described in Patent Literature 1 employs a configuration in which the antenna for ETC sticks out of a central aperture of an antenna element constituting the antenna for GPS. As such, it is necessary to increase a size of the antenna element of the antenna for GPS so that the central aperture contains the antenna for ETC.

The integrated antenna device described in Patent Literature 2 has a configuration in which, to a front surface and a rear surface of an antenna substrate standing on a base, the antenna for 3G and the antenna for GPS are attached so that the antenna for 3G and the antenna for GPS do not overlap each other. This makes it difficult to reduce a size of the integrated antenna device as viewed from a direction perpendicular to the antenna substrate. Accordingly, a demand for reduction in height of the integrated antenna device cannot be met.

The integrated antenna device described in Patent Literature 3 has a configuration in which, without taking account of the space factor, the five antennas are simply disposed so as not to overlap each other. In contrast, thoughtful devising is seen in the integrated antenna device described in Patent Literature 4, in which the antenna for ETC is disposed so as to overlap a part of the antenna for GPS. However, only a small part of the antenna for ETC overlaps the antenna for GPS, and does not serve for a fundamental reduction in size of the integrated antenna device.

Furthermore, all of the technologies described in Patent Literature 1 through 4 are intended for integrating antennas operating in GHz ranges, and are not intended for integrating an antenna operating in a MHz range (for terrestrial digital broadcasting and the like) with an antenna operating in a GHz range. In recent years when a tuner for receiving terrestrial digital broadcasting is integrated into a navigation system, there is an increasing need for integration of an antenna operating in a MHz range with an antenna operating in a GHz range. The technologies disclosed in Patent Literatures 1 through 4 have a secondary issue of not being able to meet the need.

The antenna described in Patent Literature 5 is constituted by a combination of an antenna operating in a MHz range and an antenna operating in a GHz range. Since the antenna operating in a GHz range is a three-dimensional module, it is difficult to reduce a width of the antenna.

In order to provide a loop antenna that serves for solution of these problems of conventional integrated antennas, it is important that the loop antenna exhibits a desired performance even in a state where the loop antenna overlaps another antenna, as well as that the loop antenna can easily be reduced in size. Further, in a case where the loop antenna is mounted in an integrated antenna device to be deposited on a rooftop of an automobile, it is also important that the loop antenna exhibits a desired performance even in a state where the loop antenna is disposed so as to be parallel to a conductor surface of the roof of the automobile, a metal base of the integrated antenna device, and the like.

The present invention is accomplished in view of the problems. An object of the present invention is to provide a loop antenna which can easily be reduced in size. For example, a loop antenna which can be mounted in an integrated antenna device together with another antenna and serves for reduction in size of the integrated antenna device is an example of a loop antenna which the present invention aims to provide.

Solution to Problem

In order to achieve the object, an antenna in accordance with the present invention is an antenna including: an antenna element having a shape that traces an ellipse; and a short-circuit section provided inside the ellipse, the short-circuit section causing two points on the antenna element to be short-circuited.

Advantageous Effects of Invention

The present invention makes it possible to provide a loop antenna which can easily be reduced in size. For example, the present invention makes it possible to provide a loop antenna which can be mounted in an integrated antenna device together with another antenna and serves for reduction in size of the integrated antenna device.

Figure 1:
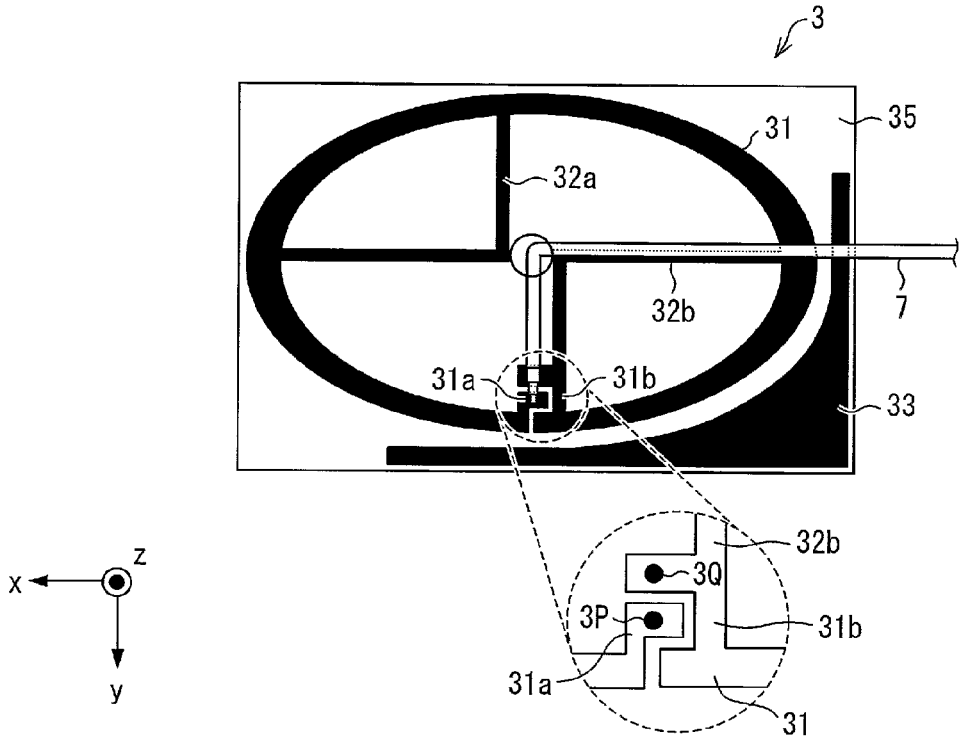
FIG. 1 is a plan view illustrating a loop antenna (antenna which serves as an antenna for GPS) in accordance with an embodiment of the present invention.
Figure 4:
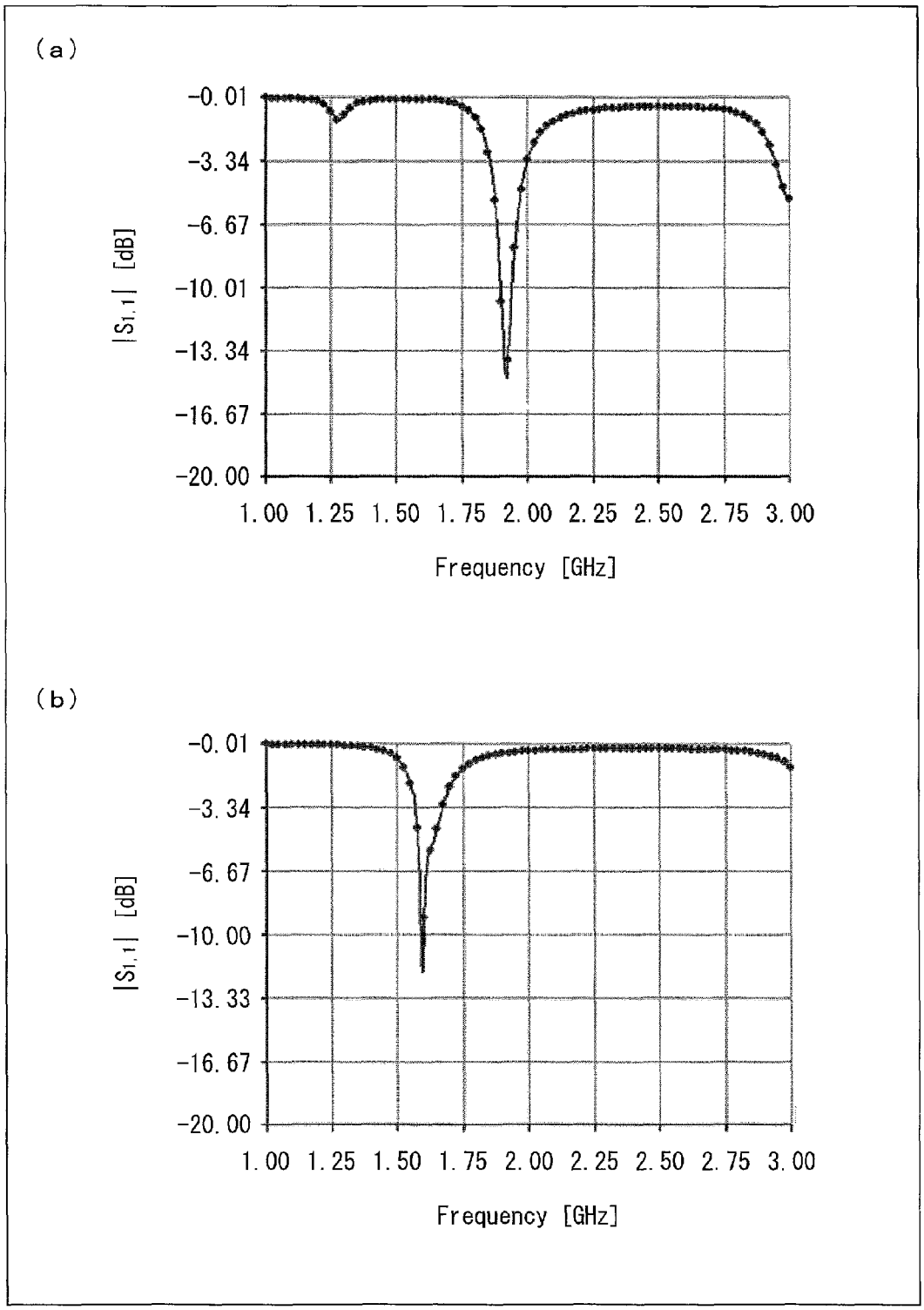

(a) of FIG. 4 is a graph showing an input reflection coefficient characteristic obtained in a case where a passive element is omitted in the antenna illustrated in FIG. 1. (b) of FIG. 4 is a graph showing an input reflection coefficient characteristic obtained in a case where the passive element and short-circuit sections are omitted in the antenna illustrated in FIG. 1.

Figure 5:
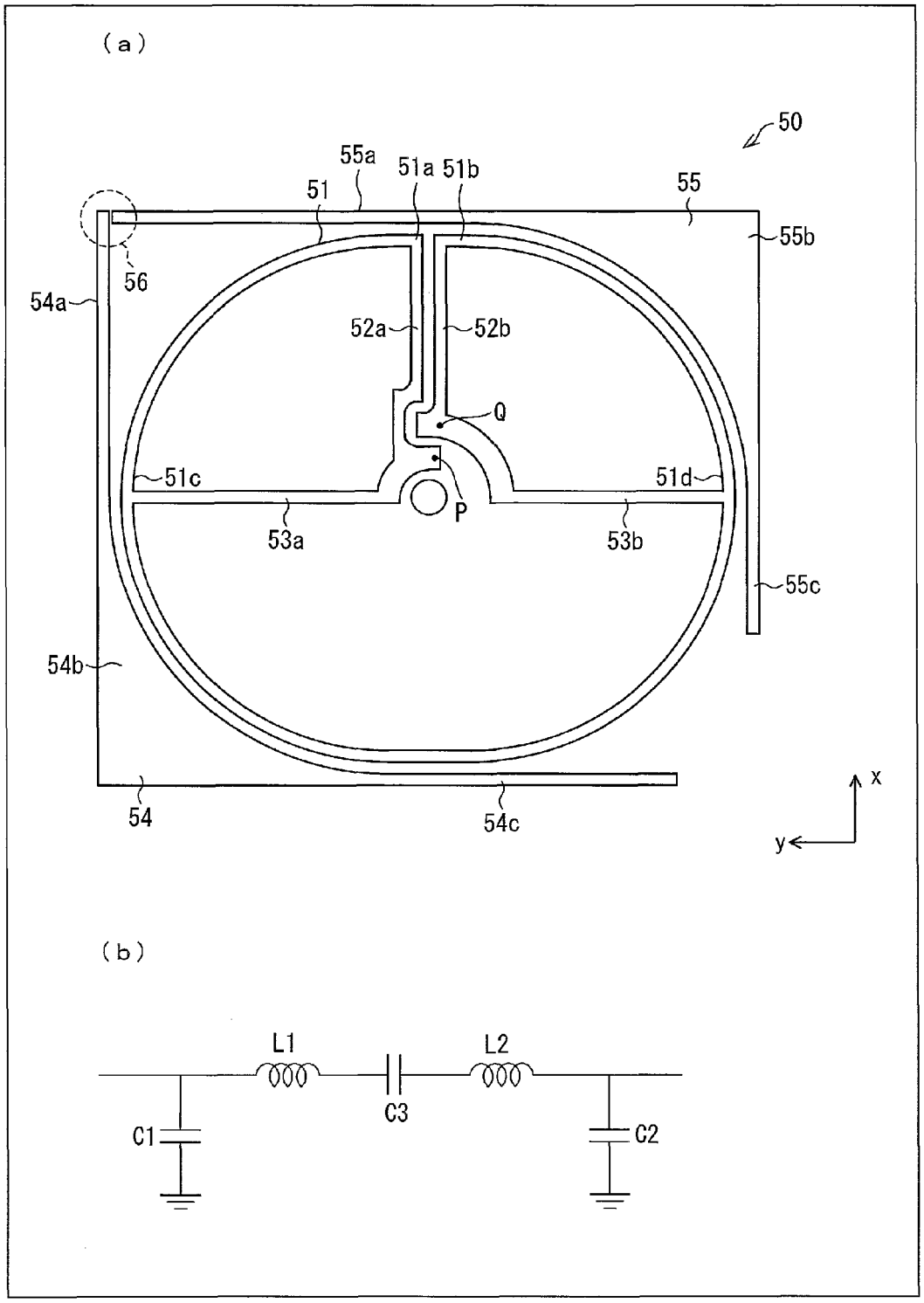

(a) of FIG. 5 is a plan view illustrating a modified example of a loop antenna. (b) of FIG. 5 is an equivalent circuit illustrating a passive element group included in the loop antenna.

Figure 6:
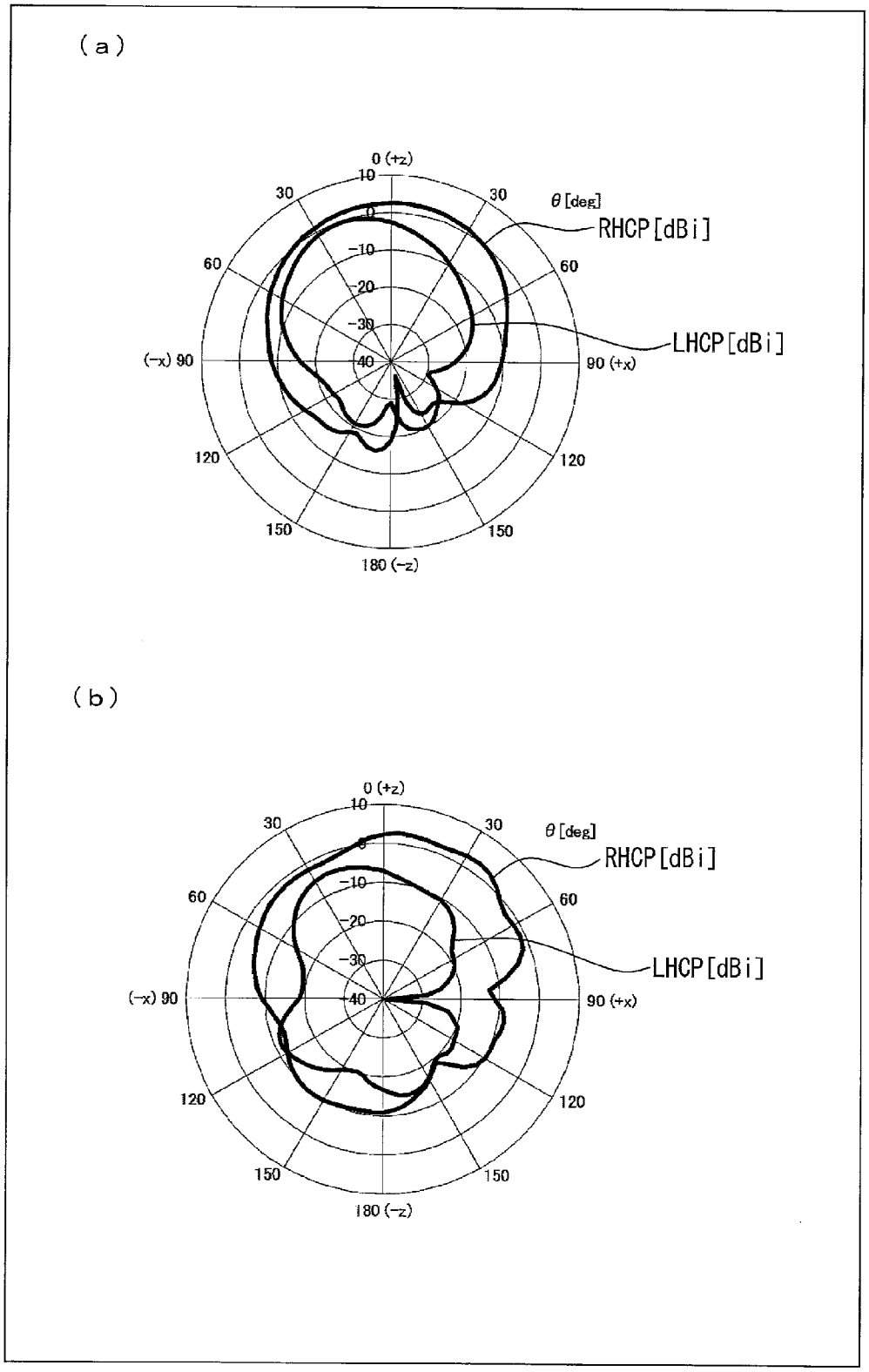

FIG. 6 shows graphs each showing radiation patterns of the loop antenna illustrated in FIG. 5.

Figure 7:
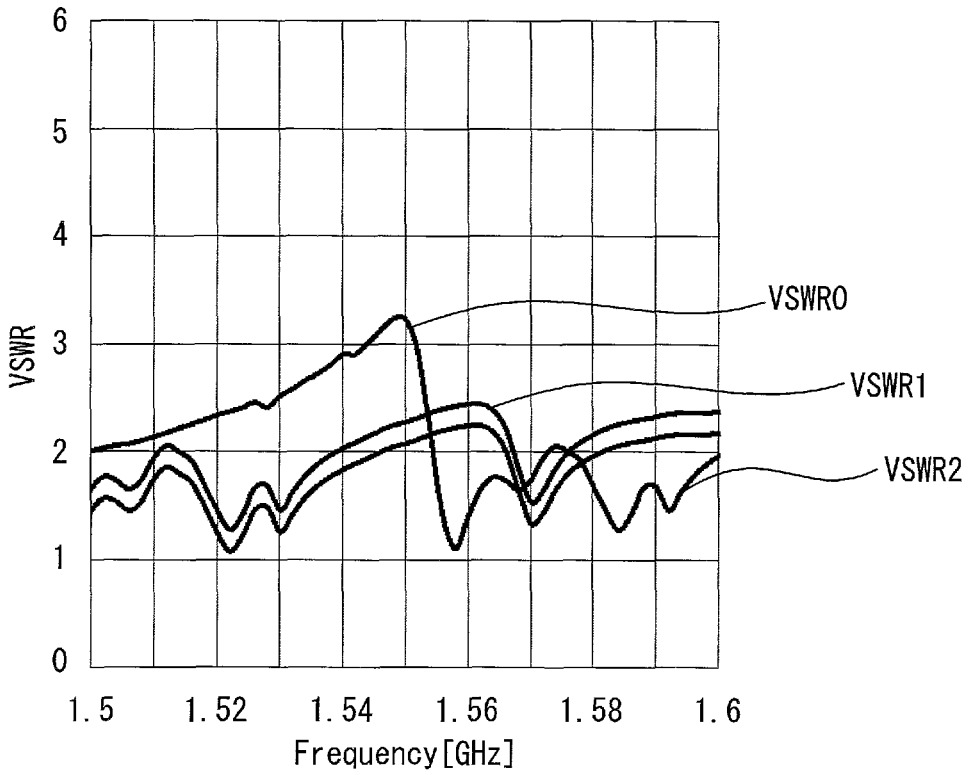

FIG. 7 is a graph showing a VSWR characteristic of the loop antenna illustrated in FIG. 5.

Figure 8:
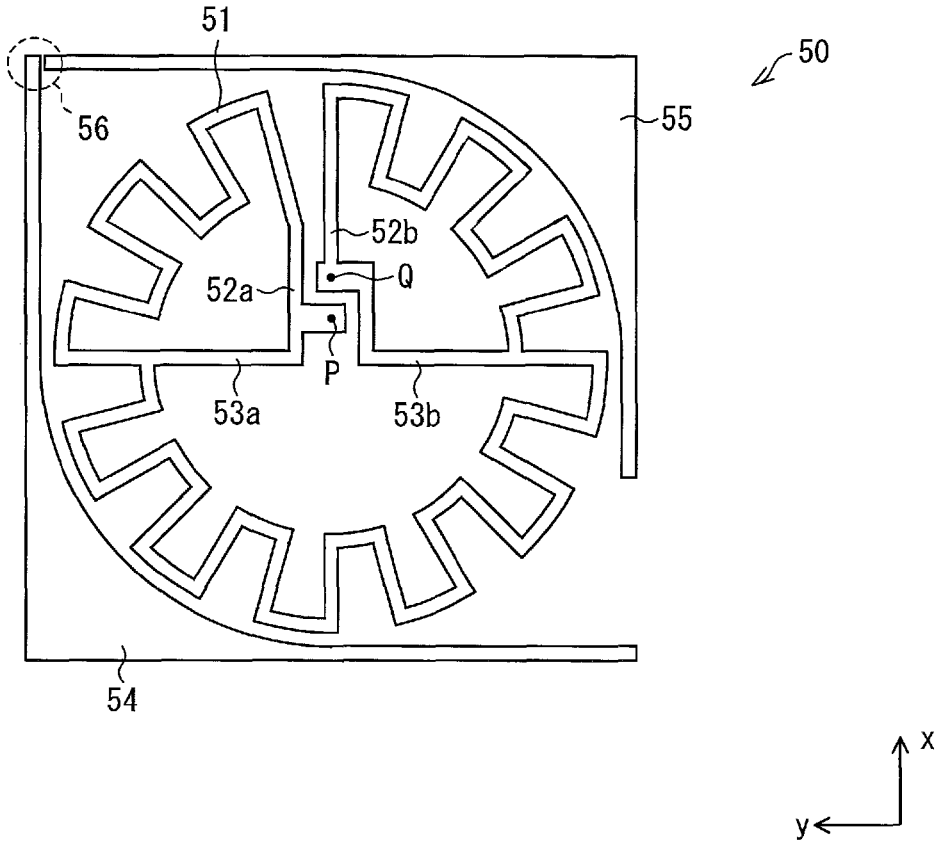

FIG. 8 is a plan view illustrating a first modified example of the loop antenna illustrated in FIG. 5.

Figure 9:
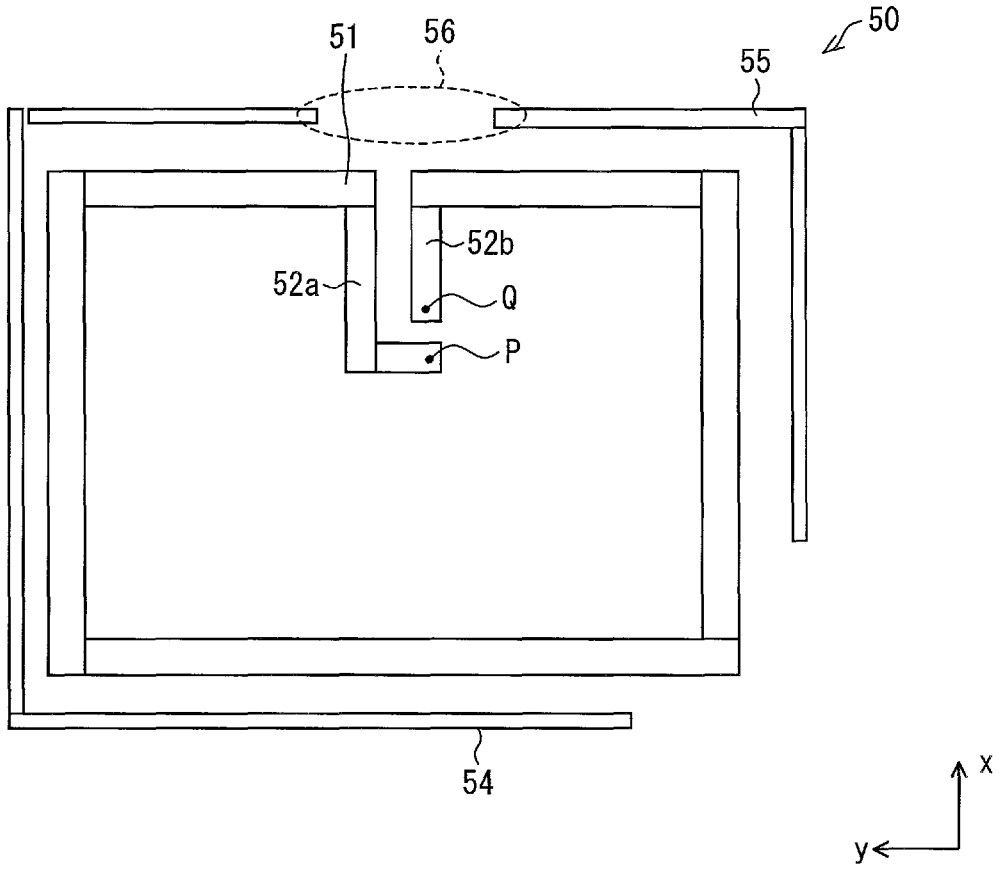

FIG. 9 is a plan view illustrating a second modified example of the loop antenna illustrated in FIG. 5.

Figure 10:
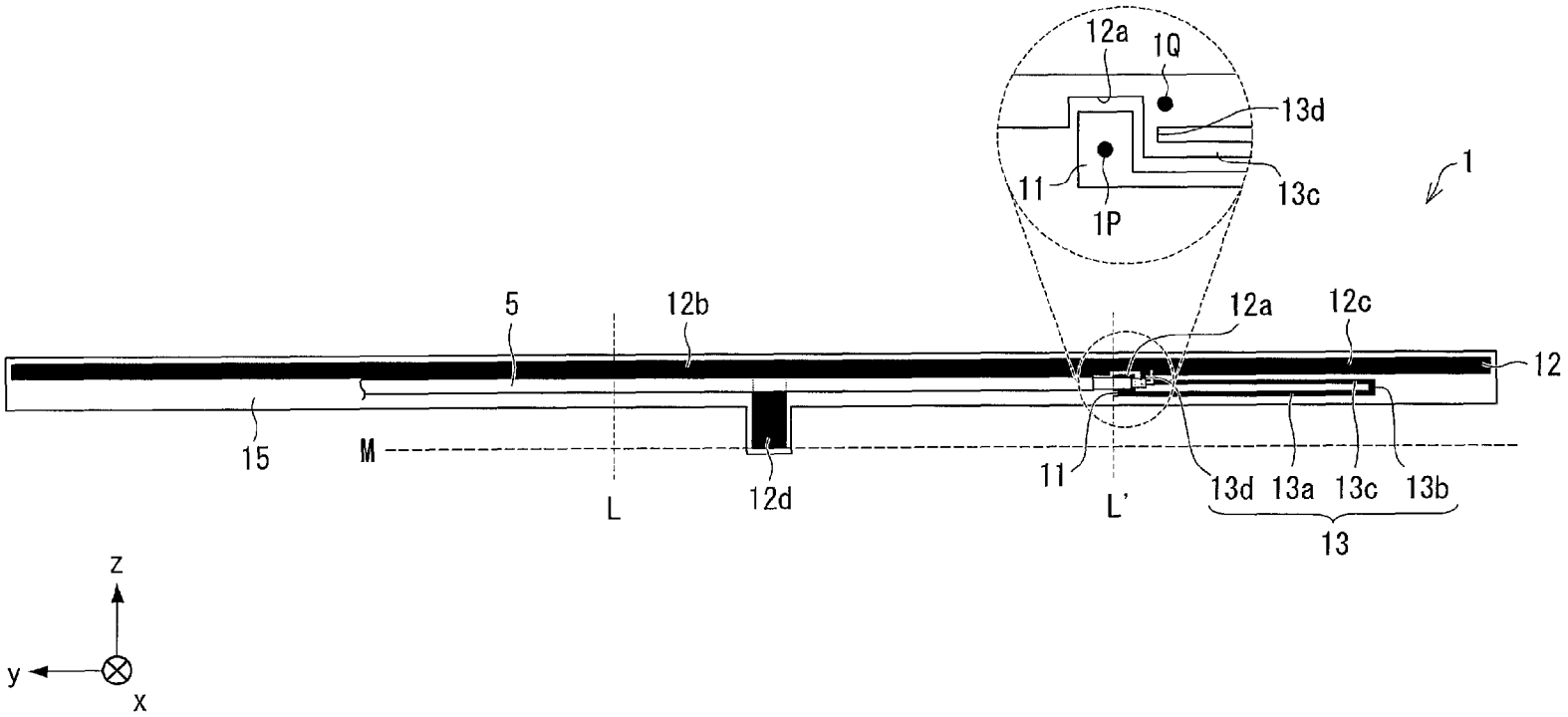

FIG. 10 is a plan view illustrating an antenna (inverted F antenna) which serves as an antenna for 3G/LTE.

Figure 11:
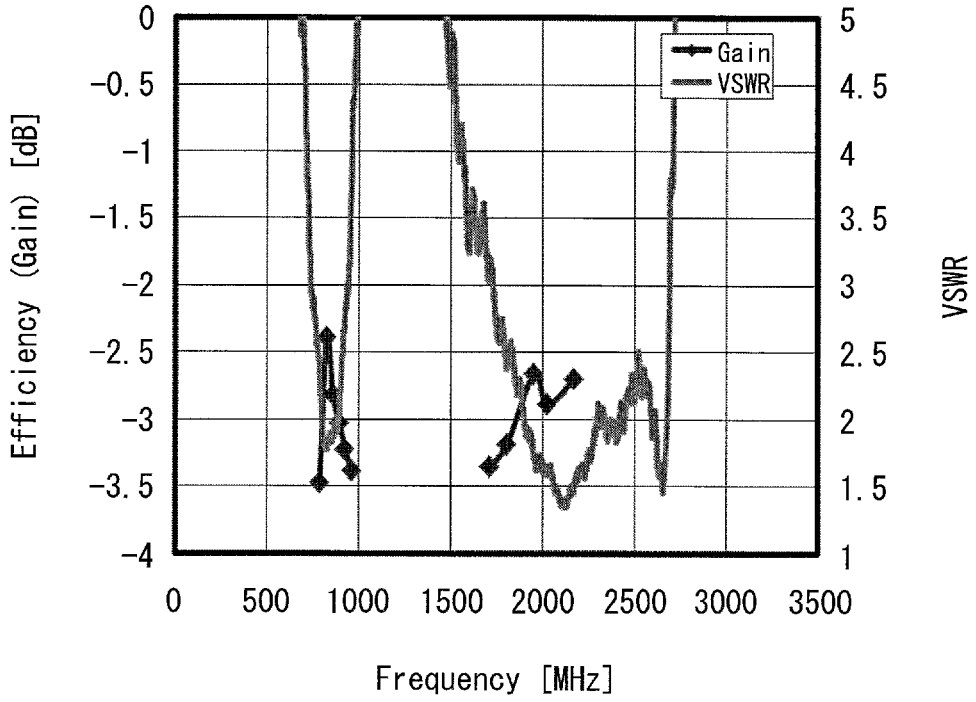

FIG. 11 is a graph showing a VSWR characteristic and a gain characteristic of the antenna illustrated in FIG. 10.

Figure 12:
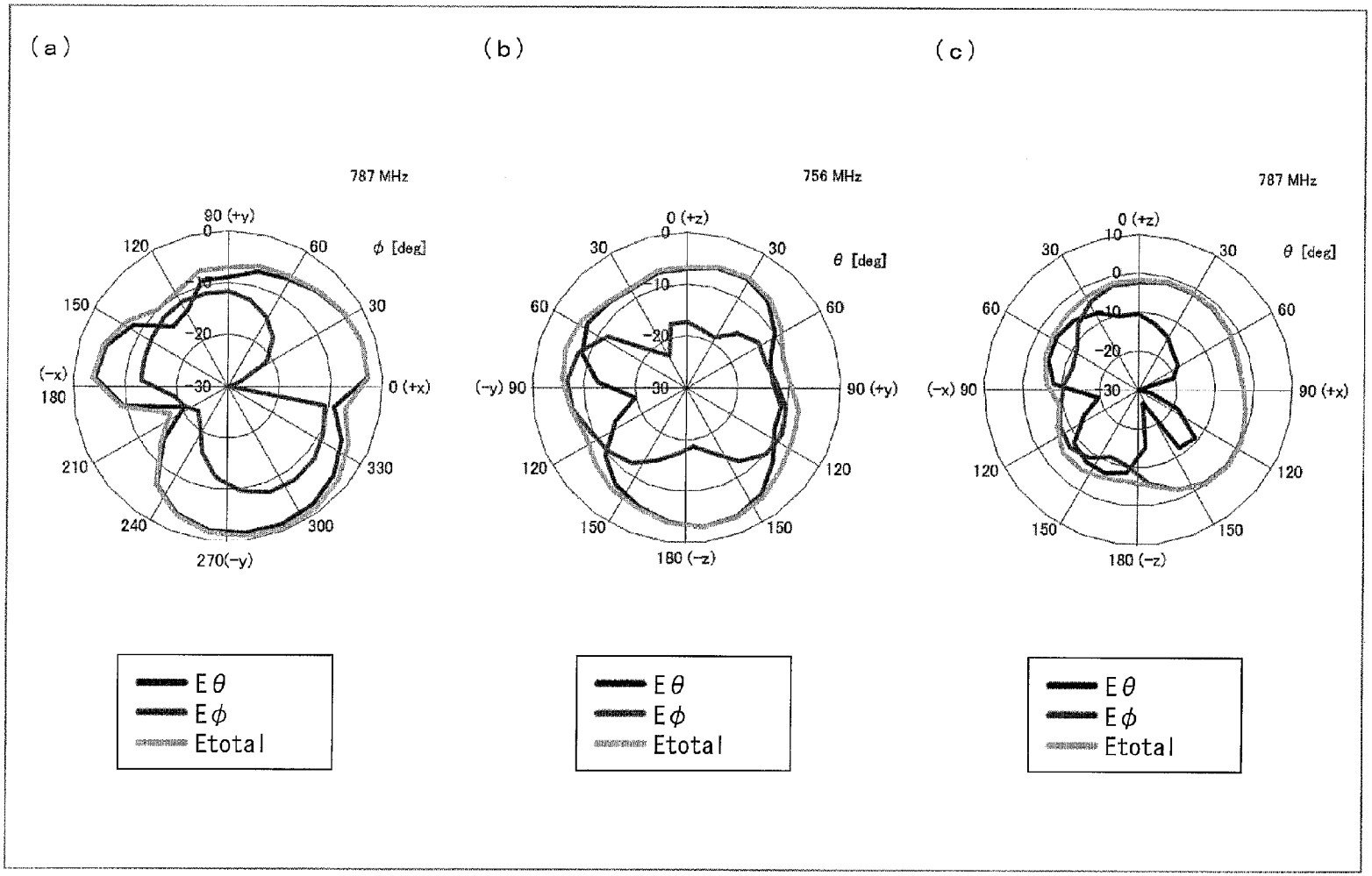

FIG. 12 shows graphs each showing radiation patterns of the antenna illustrated in FIG. 10. (a) of FIG. 12 shows radiation patterns in an x-y plane, (b) of FIG. 12 shows radiation patterns in a y-z plane, and (c) of FIG. 12 shows radiation patterns in a z-x plane.

Figure 13:
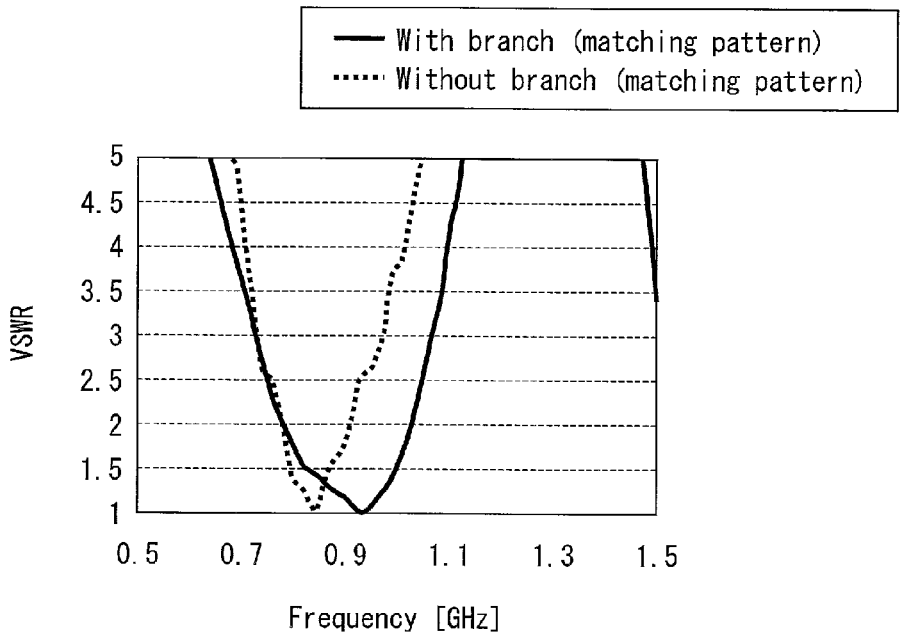

FIG. 13 is a graph comparing a VSWR characteristic obtained in a case where a branch (matching pattern) is provided in the antenna illustrated in FIG. 10 and a VSWR characteristic obtained in a case where the branch is omitted in the antenna illustrated in FIG. 10.

Figure 14:
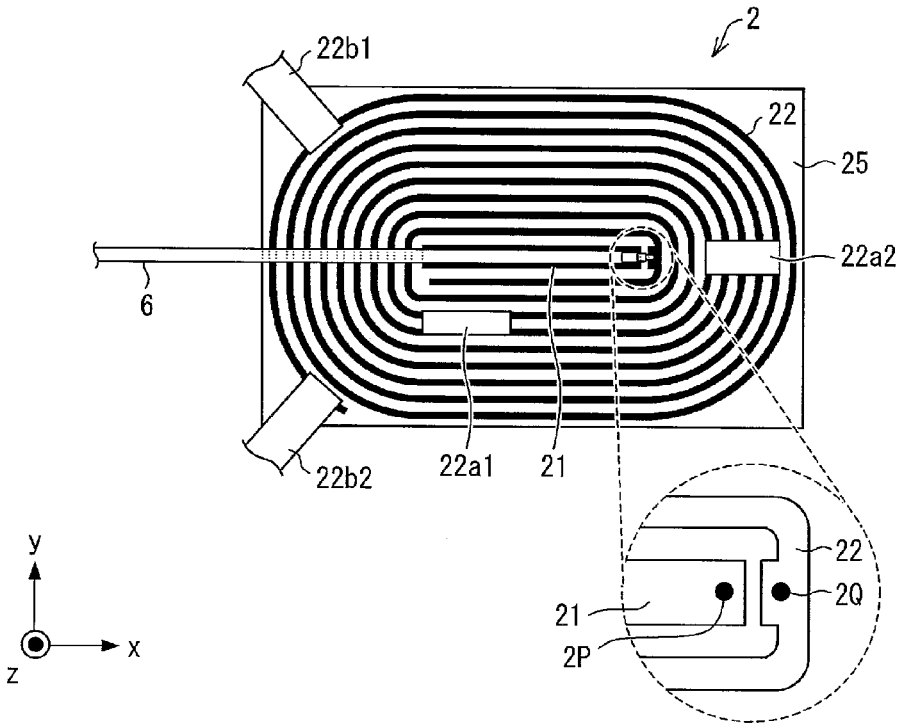

FIG. 14 is a plan view illustrating an antenna (dipole antenna) which serves as an antenna for DAB.

Figure 15:
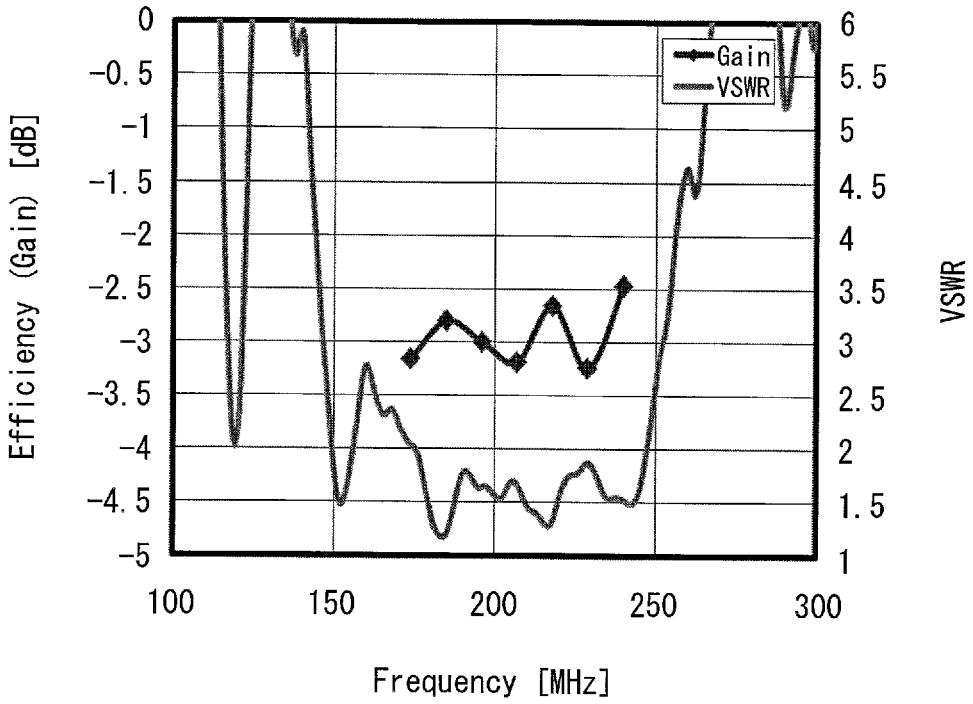

FIG. 15 is a graph showing a VSWR characteristic and a gain characteristic of the antenna illustrated in FIG. 14.

Figure 16:
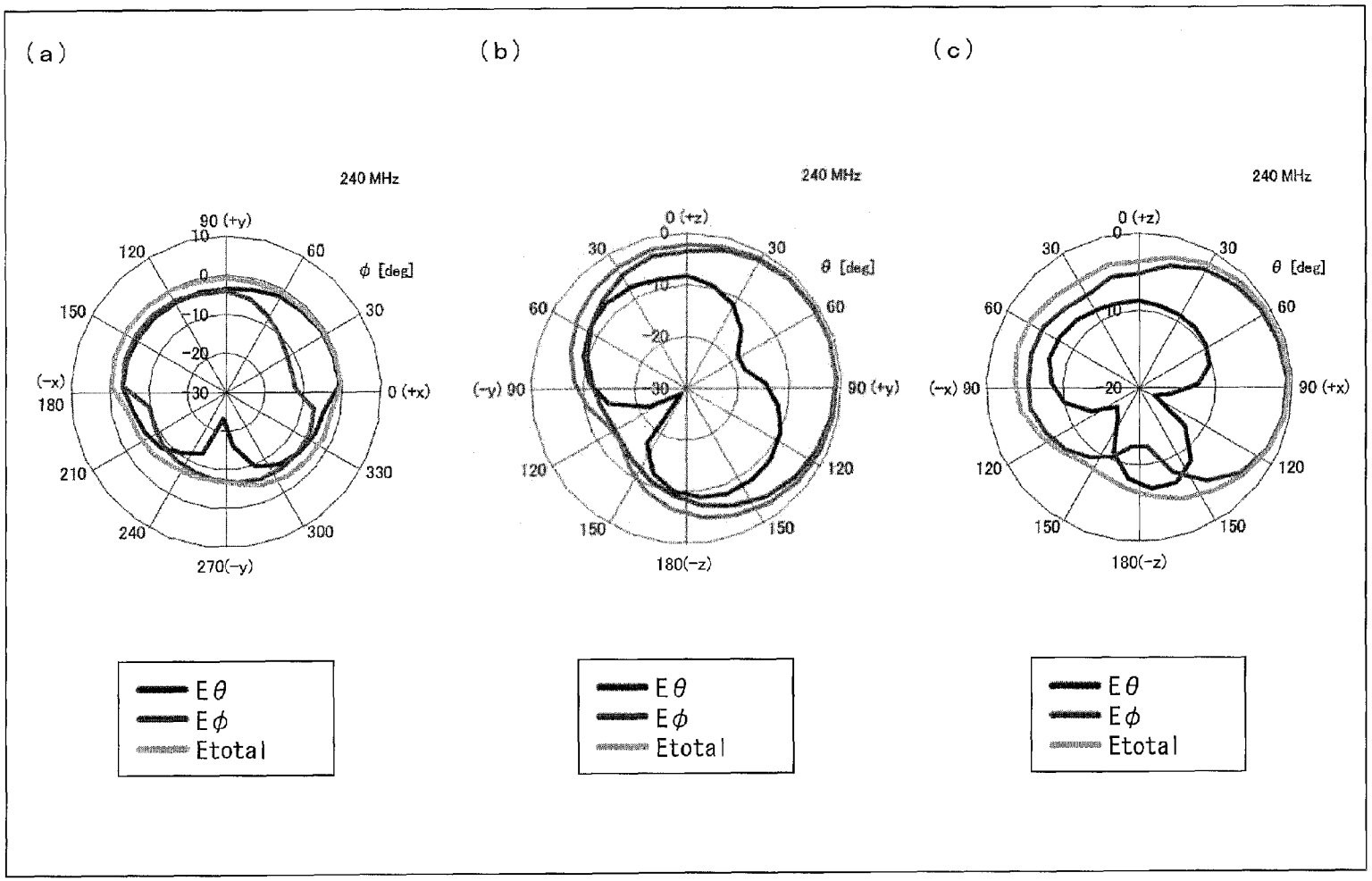

FIG. 16 shows graphs each showing radiation patterns of the antenna illustrated in FIG. 14. (a) of FIG. 16 shows radiation patterns in an x-y plane, (b) of FIG. 16 shows radiation patterns in a y-z plane, and (c) of FIG. 16 shows radiation patterns in a z-x plane.

Figure 17:
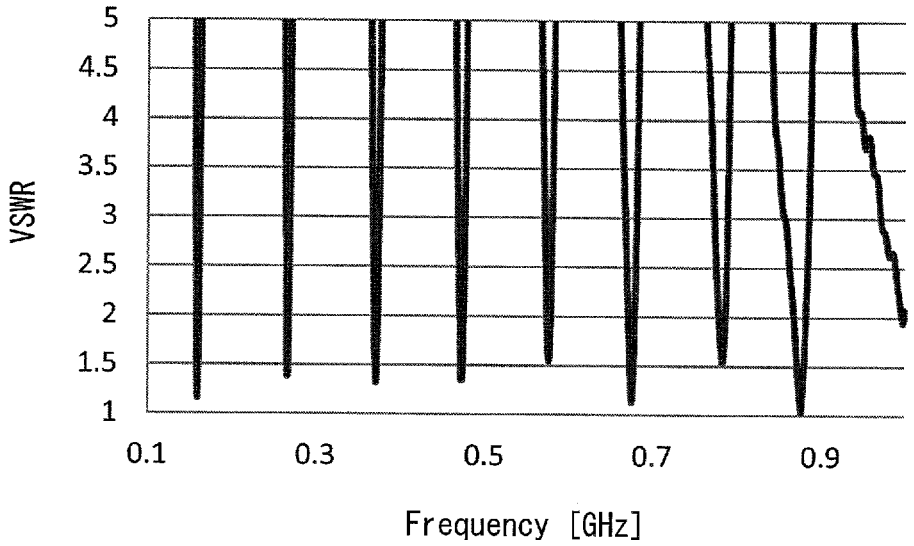

FIG. 17 is a graph showing a VSWR characteristic obtained in a case where short-circuit sections and ground sections are omitted in the antenna illustrated in FIG. 14.

Figure 18:
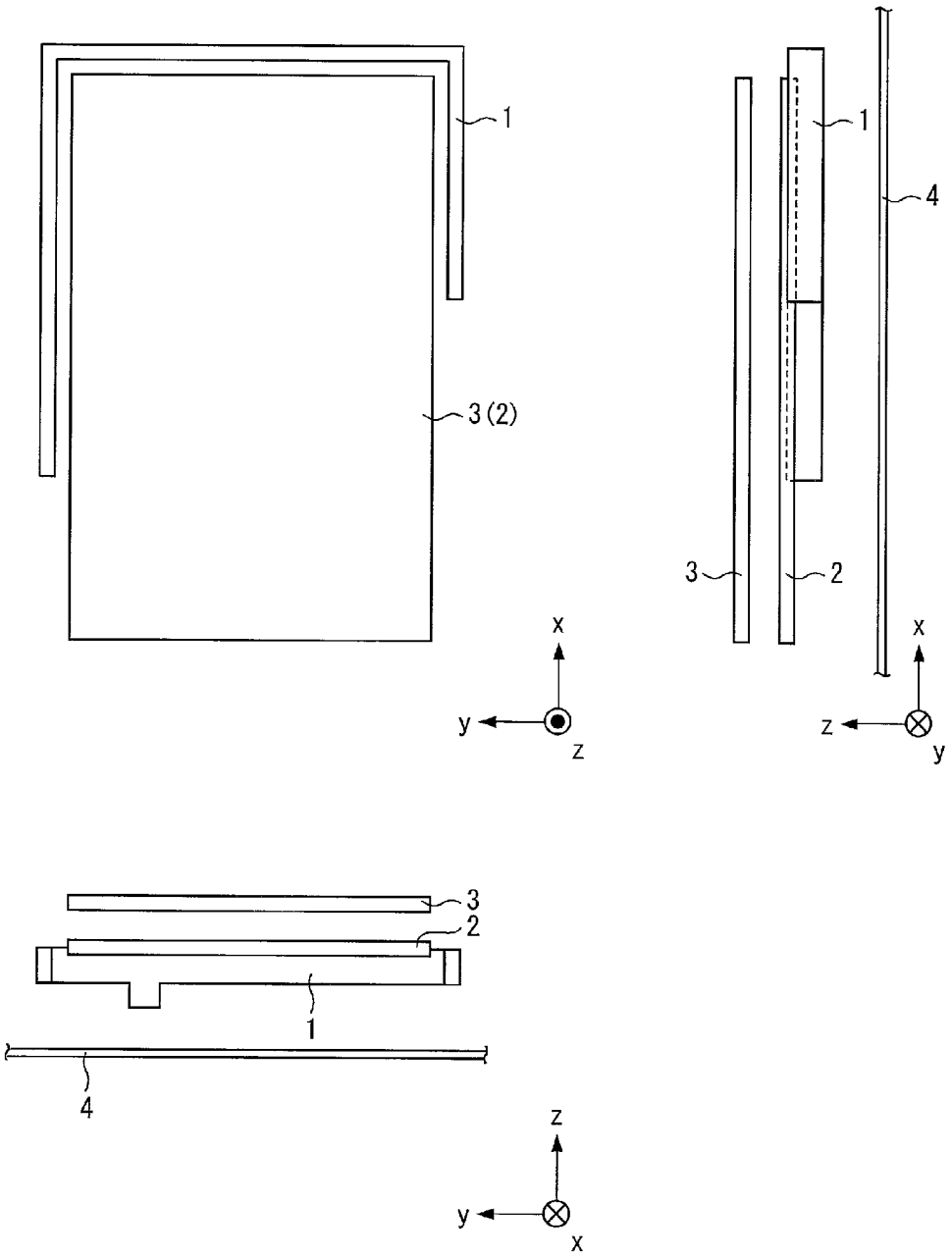

FIG. 18 is a trihedral drawing illustrating a way of combining the three antennas illustrated in FIGS. 10, 14, and 1.

Figure 19:
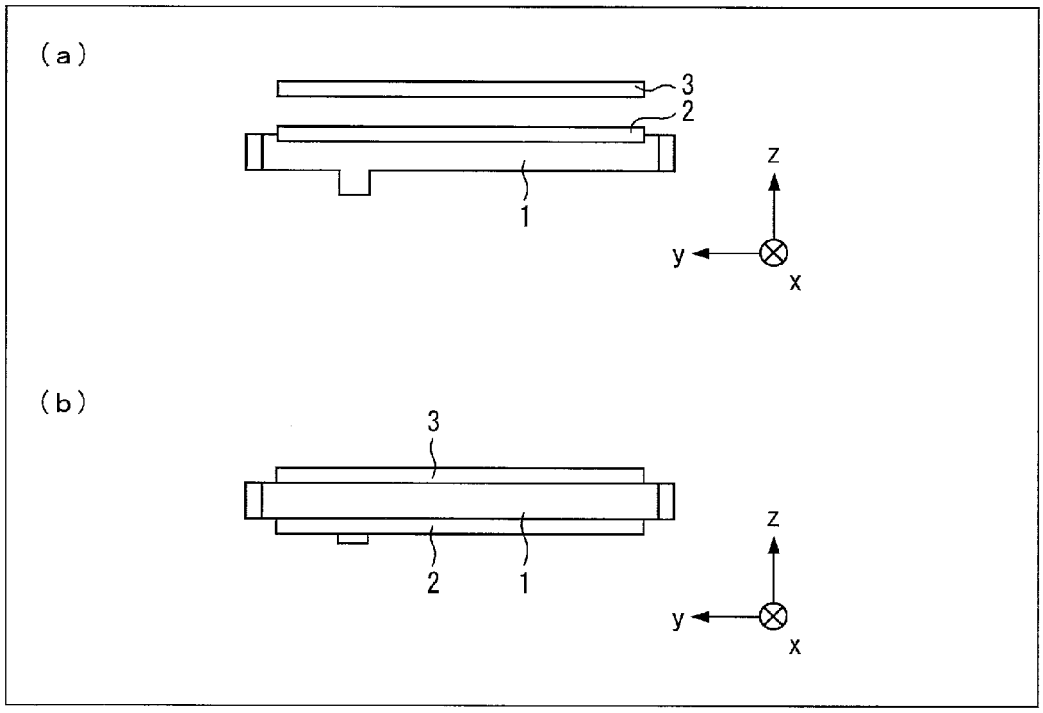

(a) of FIG. 19 is an elevation view illustrating a way of combining the antenna illustrated in FIG. 10 with the antenna illustrated in FIG. 14 in such a manner that the antenna illustrated in FIG. 10 is provided in a layer lower than a layer in which the antenna illustrated in FIG. 14 is provided. (b) of FIG. 19 is an elevation view illustrating a way of combining the antenna illustrated in FIG. 10 with the antenna illustrated in FIG. 14 and the antenna illustrated in FIG. 1 in such a manner that the antenna illustrated in FIG. 10 is provided in a middle layer between the antenna illustrated in FIG. 14 and the antenna illustrated in FIG. 1.

Figure 20:
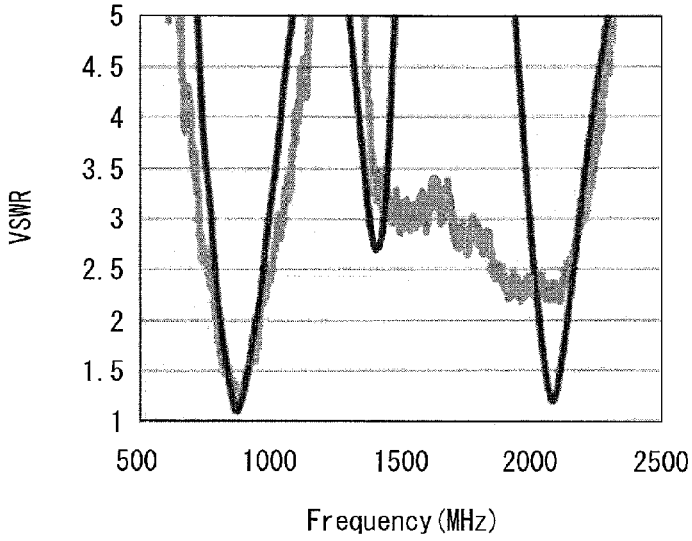

FIG. 20 is a graph comparing (i) a VSWR characteristic of the antenna illustrated in FIG. 10 obtained in a case of employing a way of combining the antenna illustrated in FIG. 10 with the antenna illustrated in FIG. 14 in such a manner that the antenna illustrated in FIG. 10 is provided in a layer lower than a layer in which the antenna illustrated in FIG. 14 is provided and (ii) a VSWR characteristic of the antenna illustrated in FIG. 10 obtained in a case of employing a way of combining the antenna illustrated in FIG. 10 with the antenna illustrated in FIG. 14 and the antenna illustrated in FIG. 1 in such a manner that the antenna illustrated in FIG. 10 is provided in a middle layer between the antenna illustrated in FIG. 14 and the antenna illustrated in FIG. 1.

Figure 21:
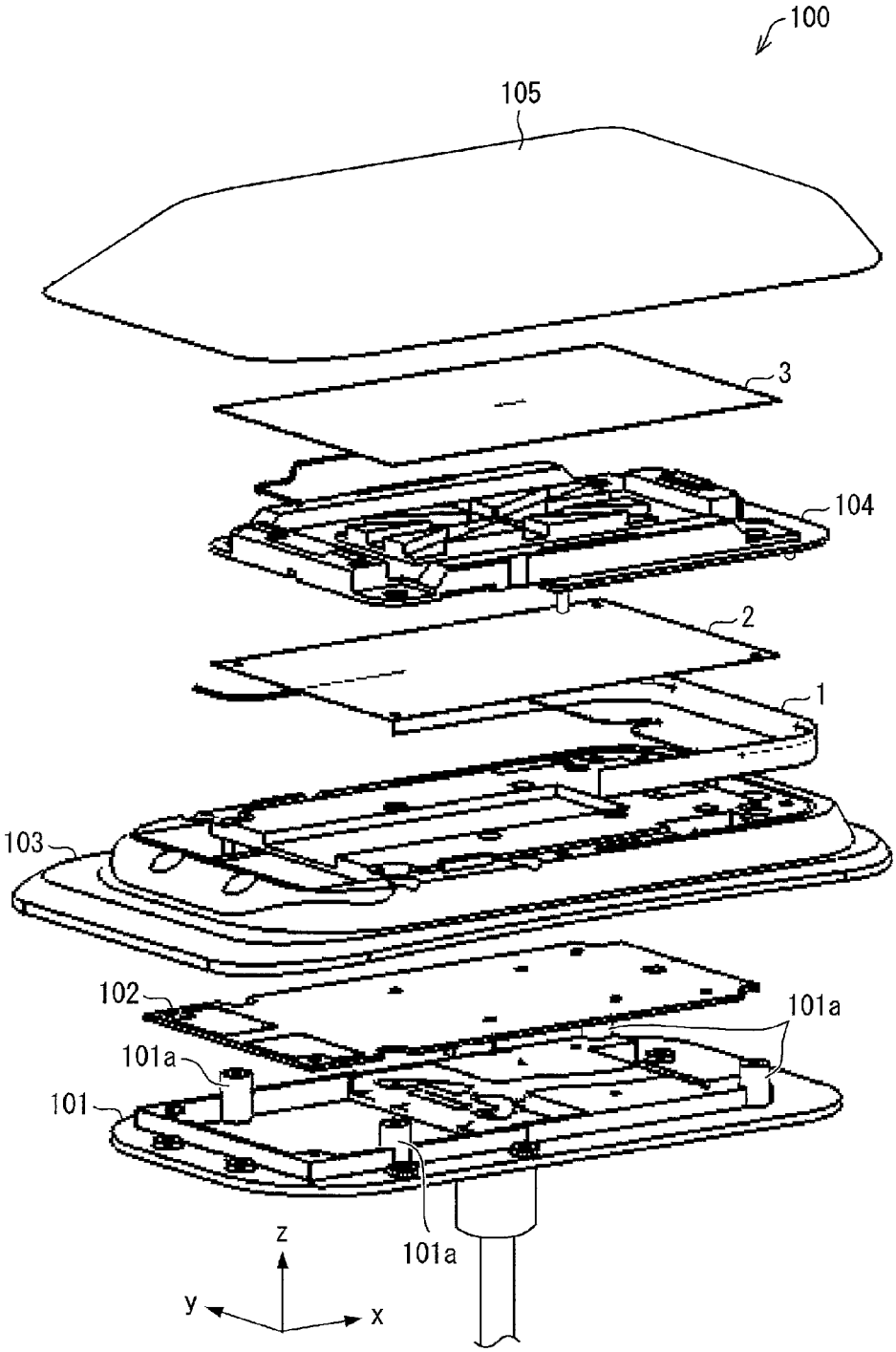

FIG. 21 is an exploded perspective view illustrating a configuration of an antenna device in which the three antennas illustrated in FIGS. 10, 14, and 1 are mounted.

DESCRIPTION OF EMBODIMENTS

[Loop Antenna]

A loop antenna in accordance with an embodiment of the present invention is described with reference to FIGS. 1 through 9. Note that the loop antenna in accordance with the present embodiment serves as an antenna for GPS (Global Positioning System). Note that the antenna for GPS denotes an antenna that operates at any frequency for GPS. The loop antenna in accordance with the present embodiment operates at 1575.42 MHz (hereinafter referred to as "required frequency"). The loop antenna in accordance with the present embodiment is hereinafter referred to as "antenna 3" with a reference numeral "3".

<<Configuration of Antenna>>

The following description discusses, with reference to FIG. 1, a configuration of the antenna 3 in accordance with the present embodiment. FIG. 1 is a plan view illustrating the antenna 3. Note that size described below of each part of the antenna 3 is merely an example, to which the present embodiment is not limited. That is, size described below of each part of the antenna 3 may be modified appropriately in accordance with materials selected, the way of design (the way of configuration), etc.

As illustrated in FIG. 1, the antenna 3 is a loop antenna including an antenna element 31, two short-circuit sections 32*a* and 32*b*, and a passive element 33. The present embodiment employs a configuration in which conductive foil constituting each of the antenna element 31, the short-circuit sections 32*a* and 32*b*, and the passive element 33 is sandwiched between a pair of dielectric films 35. Note that in the present embodiment, the pair of dielectric films 35 are each a polyimide film having a size of 50 mm×80 mm.

The antenna element 31 is constituted by a linear or belt-like conductor. In the present embodiment, the antenna element 31 is conductive foil (e.g., copper foil) having a shape of a strip that has a minimum width of 2 mm and a maximum width of 5 mm and traces an ellipse having a short axis of 42 mm and a long axis of 70 mm. Both ends of the antenna element 31 are located in a six o'clock direction as viewed from a center of the eclipse. The antenna element 31 has the minimum width at a position located in a twelve o'clock direction and a position located in the six o'clock direction as viewed from the center of the ellipse, and has the maximum width at a position located in a three o'clock direction and a position located in a nine o'clock direction as viewed from the center of the ellipse.

At a starting end section (an end section which is a starting point of a line obtained by tracing the antenna element 31 clockwise) of the antenna element 31, a first projection section 31*a* which projects toward the center of the ellipse is provided. The first projection section 31*a* has an L shape, and includes a first linear section extending upward from the starting end section of the antenna element 31 and a second linear section extending rightward from an upper end of the first linear section. At a terminus end section (an end section which is an ending point of the line obtained by tracing the antenna element 31 clockwise) of the antenna element 31, a second projection section 31*b* which projects toward the center of the ellipse is provided. The second projection section 31*b* has an L shape, and includes a first linear section extending upward from the terminus end section of the antenna element 31 and a second linear section extending leftward from an upper end of the first linear section. The first projection section 31*a* and the second projection section 31*b* are interlocked with each other so that the second linear section of the first projection section 31*a* enters a gap between the terminus end section of the antenna element 31 and the second linear section of the second projection section 31*b*.

An inner conductor of a coaxial cable 7 is connected to the first projection section 31*a* (more specifically, to the second linear section of the first projection section 31*a*). A point 3P on the first projection section 31*a* where the inner conductor of the coaxial cable 7 is connected is hereinafter referred to as a first feed point. An outer conductor of the coaxial cable 7 is connected to the second projection section 31*b* (more specifically, the fourth linear section). A point 3Q on the second projection section 31*b* where an outer conductor of the coaxial cable 7 is connected is hereinafter referred to as a second feed point. The coaxial cable 7 extracted upward from the second feed point 3Q is led to a rear surface side of the antenna 3 via a through hole formed at a center of the pair of dielectric films 35, and is extracted in the three o'clock direction.

The two short-circuit sections 32*a* and 32*b* are provided for the purpose of (i) causing a resonance frequency of the antenna 3 to shift to the required frequency and (ii) causing an input impedance of the antenna 3 to change so as to realize impedance matching.

A first short-circuit section 32*a* is constituted by a linear or belt-like conductor, and causes different two points on the antenna element 31 to be short-circuited. Specifically, the first short-circuit section 32*a* causes (i) a point (hereinafter referred to as "twelve o'clock point") on the antenna element 31 which point is located in the twelve o'clock direction as viewed from the center of the ellipse and (ii) a point (hereinafter referred to as "nine o'clock point") on the antenna element 31 which point is located in the nine o'clock direction as viewed from the center of the ellipse to be short-circuited. In the present embodiment, the first short-circuit section 32*a* is belt-like conductive foil (e.g., copper foil) including a first linear section extending downward from the twelve o'clock point of the antenna element 31 and a second linear section extending rightward from the nine o'clock point of the antenna element 31.

A second short-circuit section 32*b* is constituted by a linear or belt-like conductor, and causes different two points on the antenna element 31 to be short-circuited. Specifically, the second short-circuit section 32*b* causes (i) a point (hereinafter also referred to as "six o'clock point") on the antenna element 31 which point is located in the six o'clock direction as viewed from the center of the ellipse and (ii) a point (hereinafter also referred to as "three o'clock point") on the antenna element 31 which point is located in the three o'clock direction as viewed from the center of the ellipse to be short-circuited. In the present embodiment, the second short-circuit section 32*b* is belt-like conductive foil (e.g., copper foil) including a first linear section extending upward from the six o'clock point of the antenna element 31 and a second linear section extending leftward from the three o'clock point of the antenna element 31.

The passive element 33 is provided for the purpose of causing an input impedance of the antenna 3 to change so as to realize impedance matching.

The passive element 33 is constituted by a planar conductor having an outer edge which extends along an outer circumference of the antenna element 31. In the present embodiment, the passive element 33 is substantially L-shaped conductive foil (e.g., copper foil) which has an outer edge extending along an outer perimeter of the pair of dielectric films 35 as well as an outer edge extending along the outer circumference of the antenna element 31. Note that the passive element 33 is provided at a distance from the antenna element 31, and there is no direct-current conduction between the passive element 33 and the antenna element 31.

Note that a loop antenna has a radiation pattern in which the gain is concentrated in a direction perpendicular to a plane in which the loop antenna is provided, and the loop antenna is therefore suitable for receiving a GPS wave. This is because a GPS wave coming from a satellite located in the zenith direction can be received by the loop antenna any time and with good sensitivity, as long as the plane in which the loop antenna is provided is maintained horizontal. However, excessive concentration of the gain in the direction perpendicular to the plane in which the loop antenna is provided may cause poor reception in a case where the satellite is located in a direction other than the zenith direction or in a case where the plane in which the loop antenna is provided is not successfully maintained horizontal. The passive element 33 described above has a function of relaxing the concentration of the gain as well as the function of realizing impedance matching. As such, addition of the passive element 33 to the loop antenna brings about an effect of reducing a possibility of occurrence of such poor reception.

Note that in a case where the antenna 3 is provided parallel to the electric conductor plate 4 (see FIG. 18) as described later, the antenna 3 is electromagnetically and electrostatically coupled to the electric conductor plate 4. In this case, the antenna 3 can also be regarded as a patch antenna.

<<Characteristics of Antenna, and Effects of Short-circuit Sections and Passive Element>>

Figure 2:
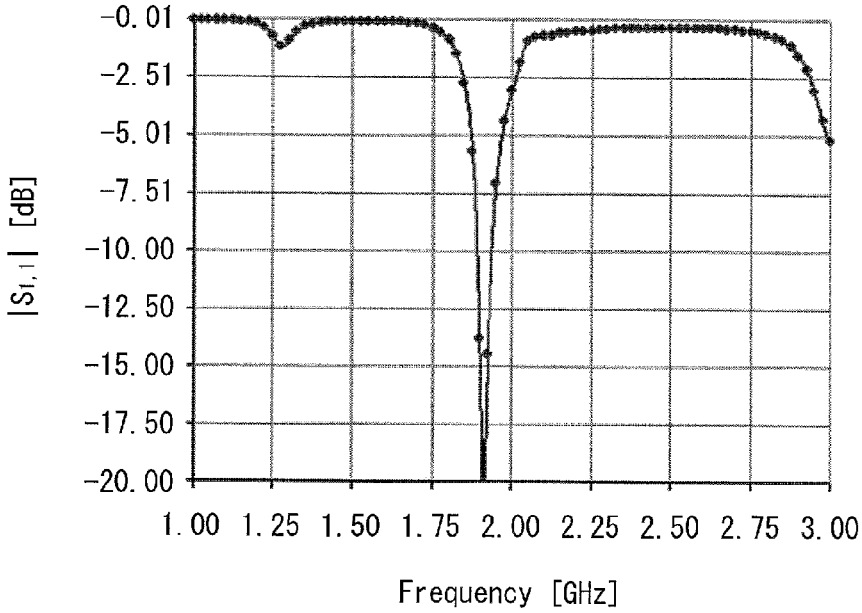
FIG. 2 is a graph showing an input reflection coefficient characteristic of the antenna illustrated in FIG. 1.
Figure 3:
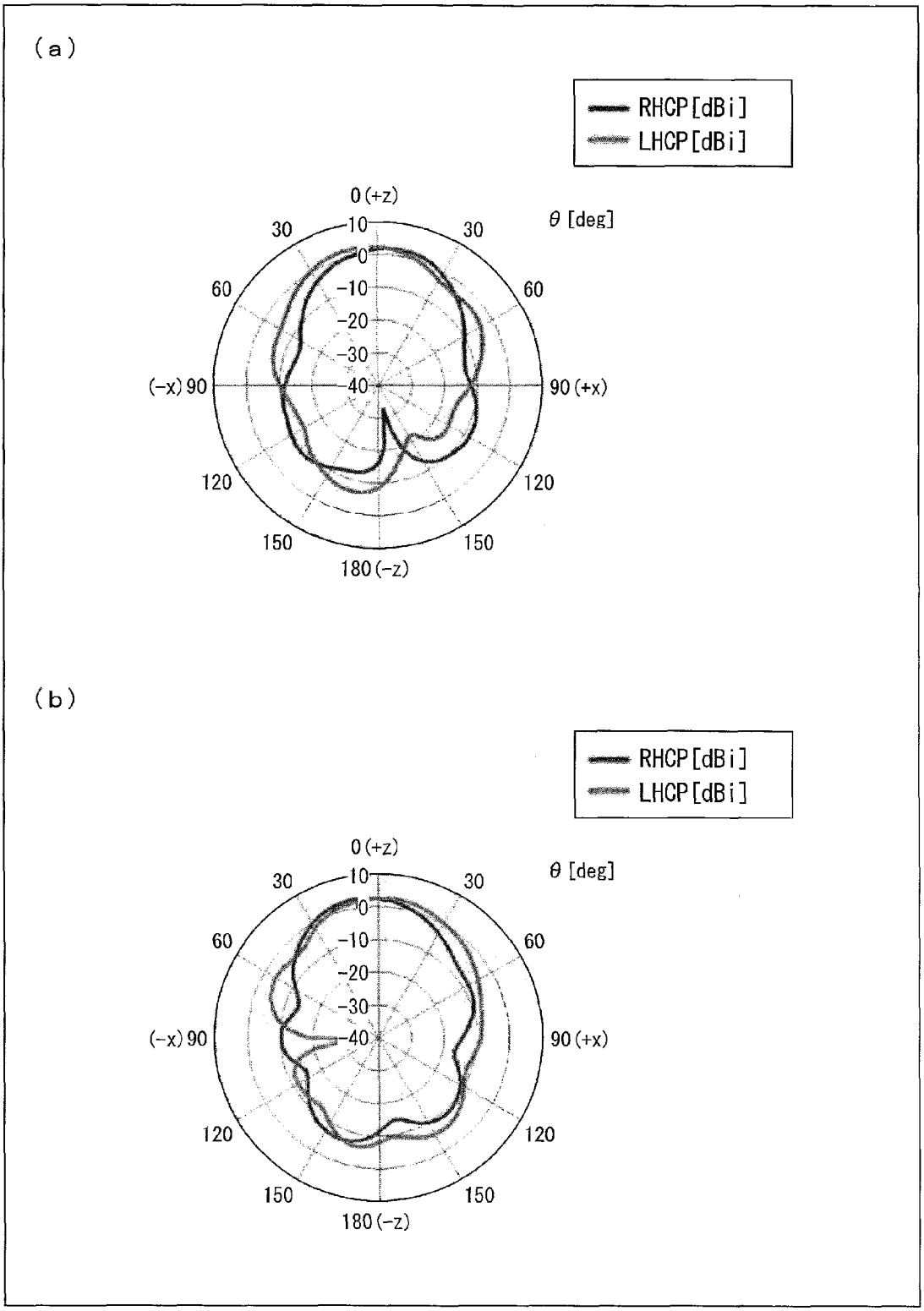
FIG. 3 shows graphs each showing radiation patterns of the antenna illustrated in FIG. 1. (a) of FIG. 3 shows radiation patterns relating to a horizontal right handed circularly polarized wave (RHCP) and a horizontal left handed circularly polarized wave (LHCP), and (b) of FIG. 3 shows radiation patterns relating to a vertical right handed circularly polarized wave (RHCP) and a vertical left handed circularly polarized wave (LHCP).

Next, the following description discusses, with reference to FIGS. 2 and 3, characteristics of the antenna 3 in accordance with the present embodiment. Note that the antenna 3 can be used in combination with an antenna 1 (see FIG. 10) and an antenna 2 (see FIG. 14), each of which will be described later. The characteristics described below are obtained in a state where the antenna 3 is combined with the antennas 1 and 2 in a specific manner of combination. The specific manner of combination will be described later with reference to FIG. 18.

FIG. 2 is a graph showing frequency dependency of a magnitude of an input reflection coefficient S1,1 of the antenna 3. The graph of FIG. 2 shows that a magnitude of the input reflection coefficient S1,1 at the required frequency is limited to −20 dB or less. That is, the graph of FIG. 2 shows that (i) the required frequency is included in an operating band of the antenna 3 and (ii) return loss at the required frequency is sufficiently suppressed.

FIG. 3 shows graphs each showing radiation patterns of the antenna 3 at 1575.42 MHz. (a) of FIG. 14 shows radiation patterns relating to a horizontal right handed circularly polarized wave (RHCP) and a horizontal left handed circularly polarized wave (LHCP), and (b) of FIG. 14 shows radiation patterns relating to a vertical right handed circularly polarized wave and a vertical left handed circularly polarized wave. The graph of FIG. 3 shows that gains of 0 dBi or higher are obtained with respect to $\theta=0°$. FIG. 3 also shows that gains of −10 dBi or higher are obtained with respect to $\theta\leq 60°$. Relatively high gains are thus obtained with respect to a relatively wide range of angles because the passive element 33 has the function of relaxing the concentration of the gain in the direction perpendicular to the plane in which the antenna is provided.

Next, the following description considers, with reference to FIG. 4, effects of the short-circuit sections 32*a* and 32*b* and the passive element 33. FIG. 4 shows graphs each showing frequency dependency of a magnitude of the input reflection coefficient S1,1. (a) of FIG. 4 shows results obtained in a case where the passive element 33 is omitted, and (b) of FIG. 4 shows results obtained in a case where the short-circuit sections 32*a* and 32*b* and the passive element 33 are omitted.

Comparison of the graph of (a) of FIG. 4 and the graph of FIG. 2 shows that omission of the passive element increases the magnitude of the input reflection coefficient S1,1 at the required frequency. This means that the provision of the passive element 33 realizes impedance matching, thereby causing a decrease in return loss at the required frequency.

Further, comparison of the graph of (b) of FIG. 4 and the graph of (a) of FIG. 4 shows that omission of the short-circuit sections 32*a* and 32*b* causes the resonance frequency to be shifted from the required frequency and increases the magnitude of the input reflection coefficient S1,1 at the resonance frequency. This means that (i) the provision of the first short-circuit section 32*a* creates a new electric current path in the antenna element 31, thereby causing a shift in resonance frequency and (ii) the provision of the second short-circuit section 32*a* realizes impedance matching, thereby causing a decrease in return loss at the resonance frequency.

[Modified Example of Loop Antenna]

Lastly, the following describes, with reference to FIGS. 5 through 9, a modified example of the loop antenna described above.

<<Configuration of Loop Antenna>>

First, a configuration of a loop antenna 50 in accordance with the modified example is described with reference to FIG. 5. (a) of FIG. 5 is a plan view illustrating a configuration of the loop antenna 50. (b) of FIG. 5 is a circuit diagram illustrating an equivalent circuit of passive elements 54 and 55 included in the loop antenna 50.

As illustrated in FIG. 5, the loop antenna 50 includes an antenna element 51, a pair of feed sections 52*a* and 52*b*, a pair of short-circuit sections 53*a* and 53*b*, a first passive element 54, and a second passive element 55. In the modified example, the antenna element 51, the feed sections 52*a* and 52*b*, and the short-circuit sections 53*a* and 53*b* are integrally formed from a sheet of conductive foil (e.g., copper foil). The first passive element 54 is constituted by another sheet of conductive foil isolated from the sheet of conductive foil constituting the antenna element 51 and the like. The second passive element 55 is constituted by still another sheet of conductive foil isolated from both the sheet of conductive foil constituting the antenna element 51 and the like and the sheet of conductive foil constituting the first passive element 54.

The antenna element 51 is constituted by a linear or belt-like conductor disposed on a closed curve. In the modified example, the antenna element 51 is belt-like conductive foil (e.g., copper foil) having a width of 1 mm and disposed on an ellipse having a short axis of 45 mm and a long axis of 52 mm. One end section 51*a* of the antenna element 51 faces the other end section 51*b* of the antenna element 51 so that a straight line extending from a center of the ellipse in a twelve o'clock direction is interposed between the one end section 51*a* and the other end section 51*b*.

The feed section 52*a* is a linear or belt-like conductor disposed on a line segment extending from the one end section 51*a* of the antenna element 51 to near the center of the ellipse. In the modified example, the feed section 52*a* is belt-like conductive foil having a width of 1 mm. A feed point P, to which an outer conductor of a coaxial cable is connected, is provided at a tip of the feed section 52*a*. Accordingly, the one end section 51*a* of the antenna element 51 is connected to the outer conductor of the coaxial cable via the feed section 52*a*.

The feed section 52*b* is a linear or belt-like conductor disposed on a line segment extending from the other end section 51*b* of the antenna element 51 to near the center of the ellipse. In the modified example, the feed section 52*b* is belt-like conductive foil having a width of 1 mm. A feed point Q, to which an inner conductor of the coaxial cable is connected, is provided at a tip of the feed section 52*b*. Accordingly, the other end section 51*b* of the antenna element 51 is connected to the inner conductor of the coaxial cable via the feed section 52*b*.

The short-circuit section 53*a* is provided for the purpose of causing the feed point P and a point 51*c*, which is on the antenna element 51 and located in a nine o'clock direction as viewed from the center of the ellipse, to be short-circuited. In the modified example, the short-circuit section 53*a* is belt-like conductive foil having a width of 1 mm and disposed on a line segment extending from the point 51*c* on the antenna element 51 to near the center of the ellipse.

The short-circuit section 53*b* is provided for the purpose of causing the feed point P and a point 51*d*, which is on the antenna element 51 and located in a three o'clock direction as viewed from the center of the ellipse, to be short-circuited. In the modified example, the short-circuit section 53*b* is belt-like conductive foil having a width of 1 mm and disposed on a straight line extending from the point 51*d* on the antenna element 51 to near the center of the ellipse.

Note that a projection section which projects toward the feed section 52*a* is provided at the tip of the feed section 52*b*. The tip of the feed section 52*a* is bent along the projection section. The tip of the feed section 52*a* located above the center of the ellipse and a tip of the short-circuit section 53*a* located on the left hand side of the center are connected to each other via a belt-like conductor (width: 2 mm) disposed on a quadrant. The tip of the feed section 52*b* located above the center of the ellipse and a tip of the short-circuit section 53*b* located on the right hand side of the center are connected to each other via a belt-like conductor (width: 2 mm) disposed on a quadrant. In the modified example, employment of this configuration allows both the feed point P and the feed point Q to be disposed on a straight line extending from the center of the ellipse in the twelve o'clock direction. This reduces stress applied to the coaxial cable which is extracted from the feed point P and the feed point Q along the straight line.

The first passive element 54 is constituted by a main section 54*b*, a first extension section 54*a*, and a second extension section 54*c*. The main section 54*b* is a substantially L-shaped planar conductor having an outer edge that extends along an outer circumference of the antenna element 51 from a position located in a six o'clock direction, as viewed from the center of the ellipse, to a position located in the nine o'clock direction. The first extension section 54*a* is a belt-like conductor which extends linearly in the twelve o'clock direction from an end section, located in a nine o'clock direction as viewed from the center of the ellipse, of the main section 54*b*. The second extension section 54*c* is a belt-like conductor which extends linearly in the three o'clock direction from an end section, located in the six o'clock direction as viewed from the center of the ellipse, of the main section 54*b*.

In the loop antenna 50, the second extension section 54*c* of the first passive element 54 has a function of causing a change in inclination of a direction in which a gain of a right handed circularly polarized wave is maximized (hereinafter referred to as "maximum gain direction"). That is, a decrease in length of the second extension section 54*c* causes a decrease in inclination of the maximum gain direction of the right handed circularly polarized wave, and an increase in length of the second extension section 54*c* causes an increase in inclination of the maximum gain direction of the right handed circularly polarized wave.

The second passive element 55 is constituted by a main section 55*b*, a first extension section 55*a*, and a second extension section 55*c*. The main section 55*b* is a substantially L-shaped planar conductor having an outer edge that extends along an outer circumference of the antenna element 51 from a position located in the twelve o'clock direction to a position located in the three o'clock direction as viewed from the center of the ellipse. The first extension section 55*a* is a belt-like conductor which extends linearly in the nine o'clock direction from an end section, located in the twelve o'clock direction as viewed from the center of the ellipse, of the main section 55*b*. The second extension section 55*c* is a belt-like conductor which extends linearly in the six o'clock direction from an end section, located in the three o'clock direction as viewed from the center of the ellipse, of the main section 55*b*.

In the loop antenna 50, the second extension section 55*c* of the second passive element 55 has a function of causing a change in resonance frequency. That is, a decrease in length of the second extension section 55*c* causes a shift in resonance frequency toward a high frequency side, and an increase in length of the second extension section 55*c* causes a shift in resonance frequency toward a low frequency side. Further, a change in length of the second extension section 55*c* causes a change in phase angle of the loop antenna 50.

A tip of the first extension section 54*a* of the first passive element 54 and a tip of the first extension section 55*a* of the second passive element 55 are capacitively-coupled to each other. That is, a gap 56 between the tip of the first extension section 54*a* of the first passive element 54 and the tip of first extension section 55*a* of the second passive element 55 has capacitance.

A passive element group made up of the first passive element 54 and the second passive element 55 is equivalent to an LC circuit illustrated in (b) of FIG. C1. In the LC circuit illustrated in (b) of FIG. C1, L1 indicates self-inductance of the first passive element 54, L2 indicates self-inductance of the second passive element 55, C1 indicates capacitance between the first passive element 54 and the ground, C2 indicates capacitance between the second passive element 55 and the ground, and C3 indicates capacitance of the gap 56. The passive element group made up of the first passive element 54 and the second passive element 55 has a resonance frequency as the LC circuit illustrated in (b) of FIG. C1.

In a case where an electric current passes through the antenna element 51, an induced current passes through the passive element group as well. Accordingly, an electromagnetic wave radiated from the loop antenna 50 is a combination of an electromagnetic wave radiated from the antenna element 51 and an electromagnetic wave radiated from the passive element group. By changing a distance of the gap 56 as appropriate so that the resonance frequency of the passive element group to be equal to that of the antenna element 51, it becomes possible to cause an intensity of an electromagnetic wave radiated from the loop antenna 50 at the resonance frequency to be higher than an intensity of an electromagnetic wave radiated from the antenna element 51 (alone) at the resonance frequency. That is, by changing the distance of the gap 56 as appropriate so that the resonance frequency of the passive element group is equal to that of the antenna element 51, a VSWR value of the loop antenna 50 in a band including the resonance frequency can be made smaller than a VSWR value of the antenna element 51 (alone) in the band.

As described above, in the loop antenna 50, the second extension section 54*c* of the first passive element 54 has the function of causing a change in the maximum gain direction of a right handed circularly polarized wave. The following discusses this point with reference to FIG. 6.

FIG. 6 shows graphs each showing radiation patterns of the loop antenna 50. (a) of FIG. 6 shows radiation patterns obtained in a case where the extension section 54*c* is not added, and (b) of FIG. 6 shows radiation patterns obtained in a case where the extension section 54*c* is added. In each of the graphs, RHCP indicates a radiation pattern of a right handed circularly polarized wave, and LHCP indicates a radiation pattern of a left handed circularly polarized wave.

In the case where the extension section 54*c* is not added, the maximum gain direction of the right handed circularly polarized wave is a direction (a z-axial direction in FIG. 5) perpendicular to a plane (an x-y plane in FIG. 5) in which the antenna is provided, as shown in (a) of FIG. 6. On the other hand, in the case where the extension section 54*c* is added, the maximum gain direction of the right handed circularly polarized wave is inclined by approximately 30°, as shown in (b) of FIG. 6.

The inclination of the maximum gain direction is changed by changing the length of the extension section 54*c*. Specifically, a decrease in length of the extension section 54*c* causes a decrease in inclination of the maximum gain direction, and an increase in length of the extension section 54*c* causes an increase in inclination of the maximum gain direction. As such, by including a step in which the length of the extension section 54*c* is adjusted while the maximum gain direction of the right handed circularly polarized wave is measured, it becomes possible to manufacture the loop antenna 50 which allows the inclination of the maximum gain direction of the right handed circularly polarized wave to have a desired value.

As described above, in the loop antenna 50, it is possible to reduce a VSWR value by appropriately adjusting the distance of the gap 56 between the first passive element 54 and the second passive element 55. The following discusses this point with reference to FIG. 7.

FIG. 7 is a graph showing VSWR characteristics of the loop antenna 50 obtained near 1.575 GHz. In FIG. 7, VSWR0 indicates a VSWR characteristic obtained in a case where both the first passive element 54 and the second passive element 55 are eliminated, VSWR1 indicates a VSWR characteristic obtained after both the first passive element 54 and the second passive element 55 are added, and VSWR1 indicates a VSWR characteristic obtained after (i) both the first passive element 54 and the second passive element 55 are added and (ii) the distance of the gap 56 is adjusted so as to minimize a VSWR value at 1.575 GHz is minimized.

As shown in FIG. 7, the addition of both the first passive element 54 and the second passive element 55 causes a decrease in VSWR value in a band not higher than 1.5 GHz and, further, the adjustment of the distance of the gap 56 causes a decrease in VSWR value at 1.575 GHz.

In this way, adjustment of the distance of the gap 56 makes it possible to cause a change in VSWR value at a desired frequency. Therefore, by including the step in which the distance of the gap 56 is adjusted while a VSWR value at a desired frequency is measured, it becomes possible to manufacture the loop antenna 50 having a low VSWR value at a desired frequency.

In the above description, the antenna element 51 is disposed on the circumference of the ellipse in the loop antenna 50. Note, however, that the modified example is not limited to this. For example, the antenna element 51 may have a meander shape as illustrated in FIG. 8, or be disposed on a perimeter of a rectangle as illustrated in FIG. 9. Further, the short-circuit sections 53*a* and 53*b* may be omitted in the loop antenna 50, as illustrated in FIG. 9.

[Mounting in Integrated Antenna Device]

In a typical example of the antenna 3 in accordance with the present embodiment, the antenna 3 is mounted in an integrated antenna device. Examples of an antenna which is mounted in an integrated antenna device together with the antenna 2 in accordance with the present embodiment include an antenna for 3G (3rd Generation)/LTE (Long Term Evolution) and an antenna for DAB (Digital Audio Broadcast). The following description sequentially discusses the antenna for 3G/LTE, the antenna for DAB, and the integrated antenna device.

[Antenna for 3G/LTE]

The following description discusses, with reference to FIGS. 10 through 13, the antenna 1 which serves as an antenna for 3G/LTE.

Note that an antenna for 3G/LTE refers to an antenna that operates both in any frequency band for 3G and any frequency band for LTE. The antenna 1 described below operates both in a frequency band not lower than 761 MHz but not higher than 960 MHz (hereinafter referred to as "low frequency-side required band") and in a frequency band not lower than 1710 MHz but not higher than 2130 MHz (hereinafter referred to as "high frequency-side required band").

<<Configuration of Antenna for 3G/LTE>>

First, the following description discusses, with reference to FIG. 10, a configuration of the antenna 1 which serves as an antenna for 3G/LTE. Note that size described below of each part of the antenna 1 is merely an example, to which the present embodiment is not limited. That is, size described below of each part of the antenna 1 may be modified appropriately in accordance with materials selected, the way of design (the way of configuration), etc.

The antenna 1 is an inverted F-shaped antenna including a ground plane 11, an antenna element 12, and a short-circuit section 13. The present embodiment employs a configuration in which conductive foil constituting each of the ground plane 11, the antenna element 12, and the short-circuit section 13 is sandwiched between a pair of dielectric films 15. Note that in the present embodiment, the pair of dielectric films 15 are each a polyimide film having a size of 5 mm×140 mm and includes a protrusion part having a size of 4 mm×4 mm.

The ground plane 11 is constituted by a planar conductor. In the present embodiment, the ground plane 11 is square conductive foil (e.g., copper foil) having a size of 2.0 mm×2.0 mm. An outer conductor of a coaxial cable 5 is connected to a central part on the ground plane 11. A point on the ground plane 11 where the outer conductor of the coaxial cable 5 is connected is hereinafter referred to as a first feed point 1P.

The antenna element 12 is constituted by a linear or belt-like conductor. In the present embodiment, the antenna element 12 is belt-like conductive foil (e.g., copper foil) having a width of 1.5 mm. The antenna element 12 has a linear shape, and is disposed so that a long axis of the antenna element 12 is parallel to an upper edge of the ground plane 11. An inner conductor of the coaxial cable 5 is connected to a left end section of the right wing 12*c* (described later) of the antenna element 12. A point on the antenna element 12 where the inner conductor of the coaxial cable 5 is connected is hereinafter referred to as a second feed point 1Q.

The antenna element 12 has formed therein a notch 12*a* with a width of 3 mm and a depth of 0.5 mm. The notch 12*a* is carved in the antenna element 12 so as to extend from a lower edge toward an upper edge of the antenna element 12, and an upper end section of the ground plane 11 is fitted in the notch 12*a*. Note that in the Description, a portion of the antenna element 12 which is located to left of the notch 12*a* in FIG. 10 is referred to as a left wing 12*b*, and a portion of the antenna element 12 which is located to the right of the notch 12*a* in FIG. 10 is referred to as a right wing 12*c*.

The antenna element 12 includes a branch 12*d* with a width of 3 mm and a length of 7 mm on the left wing 12*b*. The branch 12*d* is extracted downward from the left wing 12*b* of the antenna element 12 so as to extend parallel to a short axis (an axis orthogonal to the long axis) of the antenna element 12. The provision of the branch 12*d* causes a new electric current path to be formed in the antenna element 12. This causes a resonance frequency of the antenna 1 to be shifted.

Note that the antenna 1 is designed such that the right wing 12*c* of the antenna element 12 has a length of 33 mm so that the antenna 1 has a resonance point in the high frequency-side required band, and the left wing 12*b* of the antenna element 12 has a length of 103 mm so that the antenna 1 has a resonance point in the low frequency-side required band. Accordingly, the antenna element 12 has a total length of 139 mm which includes the width 3 mm of the notch 12*a*.

The short-circuit section 13 is provided to cause the ground plane 11 and the antenna element 12 to be short-circuited, and is constituted by a linear or belt-like conductor. In the present embodiment, the short-circuit section 13 is belt-like conductive foil (e.g., copper foil) having a width of 0.5 mm.

In the present embodiment, the short-circuit section 13 is belt-like conductive foil constituted by four linear sections 13*a* through 13*d*. A first linear section 13*a* is extracted rightward from a lower end of the ground plane 11 so as to extend parallel to the long axis of the antenna element 12. A second linear section 13*b* is extracted upward from a right end of the first linear section 13*a* so as to extend parallel to the short axis of the antenna element 12. A third linear section 13*c* is extracted leftward from an upper end of the second linear section 13*b* so as to extend parallel to the long axis of the antenna element 12. A fourth linear section 13*d* is extracted upward from a left end of the third linear section 13*c* so as to extend parallel to the short axis of the antenna element 12. The upper end section of the fourth linear section 13*d* reaches a left end of the right wing 12*c* of the antenna element 12.

The first notable point of the antenna 1 is that the antenna 1 employs a configuration in which, as illustrated in FIG. 10, the coaxial cable 5 extracted from the ground plane 11 and the branch 12*d* extracted from the antenna element 12 intersect with each other. The configuration causes an electromagnetic coupling between the antenna element 12 and the outer conductor of the coaxial cable 5. In other words, the branch 12*d* serves as an inductor interposed between the antenna element 12 and the outer conductor of the coaxial cable 5. A change in shape and/or size of the branch 12*d* causes a change in intensity of the electromagnetic coupling, and accordingly causes a change in input impedance of the antenna 1. That is, the branch 12*d* can serve as a matching pattern.

Note that although the present embodiment employs a configuration in which one branch 12*d* intersects with the coaxial cable 5, the present embodiment is not limited to this. That is, it is possible to employ a configuration in which two or more branches each having the same configuration as that of the branch 12*d* intersect with the coaxial cable 5. In this case, an input impedance of the antenna 1 can be changed by changing the shape and/or size of each of the two or more branches, or by changing the number of the two or more branches. This makes it possible to cause an input impedance of the antenna 1 to change over a wider range.

The second notable point of the antenna 1 is that the antenna 1 employs a configuration in which, as illustrated in FIG. 10, the ground plane 11 is provided inside a region defined by the antenna 12 and a straight line M which is parallel to (the long axis of) the antenna element 12 and passes through a tip of the branch 12*d*. The configuration allows a height of the antenna 1 to be limited to a length substantially equal to a sum of a width of the antenna element 12 and a length of the branch 12*d*. That is, the configuration allows the antenna 1 to have a small height.

Note that the configuration above is realized due to designing the ground plane 11 to be small sized. In a case of designing the antenna 1 such that an upper part of the ground plane 11 is fitted in the notch 12*a* as illustrated in FIG. 10, the configuration above is realized by designing a size of the ground plane 11 along a shorter side direction of the antenna element 12 to be shorter than a sum of the length of the branch 12*d* and the depth of notch 12*a*. In a case of designing the antenna 1 such that the upper part of the ground plane 11 is not fitted in the notch 12*a*, the configuration above can be realized by designing the size of the ground plane 11 along the shorter side direction of the antenna element 12 to be shorter than the length of the branch 12*d*. Note that in a case of designing the ground plane 11 to be thus small sized, it is preferable that the coaxial cable 5 be laid along a conductor surface of a chassis or the like. This is because the conductor surface of the chassis or the like coupled (electrostatically coupled and/or electromagnetically coupled) to the outer conductor of the coaxial cable 5 can complement a function of the ground plane 11 in this case.

Note that the antenna 1 is designed to exhibit a desired performance when the antenna 1 is bent. More specifically, the antenna 1 is designed to exhibit a desired performance when the antenna 1 is bent along two straight lines L and L', both extending along a short axial direction of the antenna element 12, so that an end surface of the antenna 1 has a U-like shape.

<<Characteristics of Antenna for 3G/LTE, and Effect of Branch>>

The following description discusses, with reference to FIGS. 11 and 12, characteristics of the antenna 1 which serves as an antenna for 3G/LTE. Note that the antenna 1 is designed on the assumption that the antenna 1 is used in combination with the antenna 2 (see FIG. 14) to be described later and the antenna 3 (see FIG. 1) described above. The characteristics described below are obtained in a state where the antenna 1 is combined with the antennas 2 and 3 in a specific manner of combination. The specific manner of combination will be described later with reference to FIG. 18.

FIG. 11 is a graph showing frequency dependency of VSWR (Voltage Standing Wave Ratio) and efficiency (gain). The graph of FIG. 11 shows that, both in the low frequency-side required band and the high frequency-side required band, VSWR is suppressed to a value not higher than 3, that is, return loss is sufficiently suppressed. The graph of FIG. 11 also shows that gain is maintained at a value not lower than −3.5 dB both in the low frequency-side required band and the high frequency-side required band. In other words, the graph of FIG. 11 shows that both the low frequency-side required band and the high frequency-side required band are operating bands of the antenna 2.

FIG. 12 shows graphs each showing radiation patterns at 787 MHz. (a) of FIG. 12 shows radiation patterns in an x-y plane, (b) of FIG. 12 shows radiation patterns in a y-z plane, and (c) of FIG. 12 shows radiation patterns in a z-x plane. The graphs of FIG. 12 show that substantially nondirectional radiation patterns are realized at least at 787 MHz.

Next, the following description considers an effect of the branch 12*d* with reference to FIG. 13. FIG. 13 is a graph showing frequency dependency of VSWR obtained in a case where the branch 12*d* is provided and frequency dependency of VSWR obtained in a case where the branch 12*d* is omitted.

As shown in FIG. 13, the provision of the branch 12*d* causes a shift in resonance frequency toward the high-frequency side, and also realizes impedance matching to thereby increase a width of the operating band. For example, when a frequency band in which VSWR is not higher than 3 is assumed to be an operating band of the antenna 1, the provision of the branch 12*d* increases the width of the operating band of the antenna 1 by approximately 1.5 times.

[Antenna for DAB]

The following description discusses, with reference to FIGS. 14 through 17, the antenna 2 which serves as an antenna for DAB. Note that an antenna for DAB refers to an antenna that operates in any frequency band for DAB. The antenna 2 described below operates in a frequency band not lower than 174 MHZ but not higher than 240 MHz (hereinafter referred to as "required band").

<<Configuration of Antenna for DAB>>

The following description discusses, with reference to FIG. 14, a configuration of the antenna 2 which serves as an antenna for DAB. FIG. 14 is a plan view illustrating the antenna 2. Note that size described below of each part of the antenna 2 is merely an example, to which the present embodiment is not limited. That is, size described below of each part of the antenna 2 may be modified appropriately in accordance with materials selected, the way of design (the way of configuration), etc.

The antenna 2 is a dipole antenna including a first antenna element 21 and a second antenna element 22. The present embodiment employs a configuration in which conductive foil constituting each of the first antenna element 21 and the second antenna element 22 is sandwiched between a pair of dielectric films 25. Note that in the present embodiment, each of the pair of dielectric films 25 is polyimide film having a size of 50 mm×80 mm.

The first antenna element 21 and the second antenna element 22 are each constituted by a linear or belt-like conductor. In the present embodiment, the first antenna element 21 is belt-like conductive foil (e.g., copper foil) having a width of 3.5 mm, and the second antenna element 22 is belt-like conductive foil (e.g., copper foil) having a width of 1.0 mm.

The first antenna element 21 has a linear shape and has a length of 32.5 mm. An outer conductor of a coaxial cable 6 is connected to a right end section of the first antenna element 21. A point 2P on the first antenna element 21 where the outer conductor of the coaxial cable 6 is connected is hereinafter referred to as a first feed point.

The second antenna element 22 has a spiral shape that circles around the first antenna element 21. An inner conductor of the coaxial cable 6 is connected to a part of an innermost circumference of the second antenna element 22 which part faces the right end section of the first antenna element 21. A point 2Q on the second antenna element 22 where the inner conductor of the coaxial cable 6 is connected is hereinafter referred to as a second feed point.

In the present embodiment, the second antenna element 22 has a spiral shape which is formed by alternating a linear section and a quadrant section and circles counterclockwise by 9×360°. A (4k+1)th (k=0, 1, . . . , 8) linear section counted from an end of the second antenna element 22 on an inner circumference side thereof extends below the first antenna element 21 so as to be parallel to a long axis of the first antenna element 21, and has a length of 31.5 mm (k=0) or 33 mm (k=1, 2, . . . , 8). A (4k+2)th (k=0, 1, . . . , 8) linear section counted from the end of the second antenna element 22 on the inner circumference side extends on the right hand side of the first antenna element 21 so as to be parallel to a short axis of the first antenna element 21, and has a length of 3.5 mm. A (4k+3)th (k=0, 1, . . . , 8) linear section counted from the end of the second antenna element 22 on the inner circumference side extends above the first antenna element 21 so as to be parallel to the long axis of the first antenna element 21, and has a length of 33 mm. A (4k+4)th (k=0, 1, . . . , 8) linear section counted from the end of the second antenna element 22 on the inner circumference side extends on the left hand side of the first antenna element 21 so as to be parallel to the short axis of the first antenna element 21, and has a length of 6 mm. A radius of a quadrant section gradually increases as a distance between the quadrant section and the innermost circumference increases (as a distance between the quadrant section and an outermost circumference of the second antenna element 22 decreases), so that the second antenna element 22 has the spiral shape. Note that a quadrant section constituting the innermost circumference has an outer radius of 2.5 mm, and a quadrant section constituting the outermost circumference has an outer radius of 22.5 mm.

In order for the antenna 2 to have a resonance point within the required band, it is necessary that a total length of the antenna elements 21 and 22 (a sum of a length of the first antenna element 21 and a length of the second antenna element 22) be approximately 75 cm (λ/2). The second antenna element 22 has the spiral shape as described above so that the antenna elements 21 and 22 satisfying this requirement are contained in an area of 50 mm×80 mm.

The second antenna element 22 includes short-circuit sections 22*a*1 and 22*a*2 and ground sections 22*b*1 and 22*b*2. The short-circuit sections 22*a*1 and 22*a*2 and the ground sections 22*b*1 and 22*b*2 are provided for the purpose of preventing a range in which a VSWR value exceeds a prescribed value (e.g., 2.5) from being formed in the required band.

The short-circuit sections 22*a*1 and 22*a*2 are each a planar conductor for causing different points on the second antenna element 22 to be short-circuited. More specifically, a first short-circuit section 22*a*1 is rectangular conductive foil (e.g., aluminum foil) which causes two linear sections (third and fourth linear sections counted from the inner circumference side) located below the first antenna element 21 to be short-circuited among the linear sections constituting the second antenna element 22. A second short-circuit section 22*a*2 is rectangular conductive foil (e.g., aluminum foil) which causes five linear sections (fourth through eighth linear sections counted from the inner circumference side) located on the right hand side of the first antenna element 21 to be short-circuited among the linear sections constituting the second antenna element 22.

The ground sections 22*b*1 and 22*b*2 are each a linear or belt-like conductor which grounds a point on the outermost circumference of the second antenna element 22. More specifically, the first ground section 22*b*1 is belt-like conductive foil (e.g., aluminum foil) which grounds a point on a quadrant section located to the upper left of the first antenna element 21 among the quadrant sections constituting the outermost circumference of the second antenna element 22. The second ground section 22*b*2 is belt-like conductive foil (e.g., aluminum foil) which grounds a point on a quadrant section located to the lower left of the first antenna element 21 among the quadrant sections constituting the outermost circumference of the second antenna element 22.

<<Characteristics of Antenna for DAB, and Effect of Short-Circuit Sections and Ground Sections>>

Next, the following description discusses, with reference to FIGS. 15 and 16, characteristics of the antenna 2 which serves as an antenna for DAB. Note that the antenna 2 is designed on the assumption that the antenna 2 is used in combination with the antenna 1 (see FIG. 10) described above and the antenna 3 (see FIG. 1) to be described later. The characteristics described below are obtained in a state where the antenna 2 is combined with the antennas 1 and 3 in a specific manner of combination. The specific manner of combination will be described later with reference to FIG. 18.

FIG. 15 is a graph showing frequency dependency of VSWR and efficiency (gain). The graph of FIG. 15 shows that, throughout the required band, VSWR is suppressed to a value not higher than 2.5, that is, return loss is sufficiently suppressed. The graph of FIG. 15 also shows that gain is maintained at a value not lower than −3.5 dB throughout the required band. In other words, the graph of FIG. 15 shows that a whole of the required band is an operating band of the antenna 2.

FIG. 16 shows graphs each showing radiation patterns at 240 MHz. (a) of FIG. 16 shows radiation patterns in an x-y plane, (b) of FIG. 16 shows radiation patterns in a y-z plane, and (c) of FIG. 16 shows radiation patterns in a z-x plane. The graphs of FIG. 16 show that substantially nondirectional radiation patterns are realized at least at 240 MHz.

Next, the following description considers, with reference to FIG. 17, an effect of the short-circuit sections 22*a* and 22*b* and the ground sections 22*c* and 22*d*. FIG. 17 is a graph showing frequency dependency of VSWR obtained in a case where the short-circuit sections 22*a* and 22*b* and the ground sections 22*c* and 22*d* are omitted.

As shown in FIG. 17, in a case where the short-circuit sections 22*a* and 22*b* and the ground sections 22*c* and 22*d* are omitted, the required band includes ranges in which a VSWR value exceeds a prescribed value (e.g., 2.5). FIG. 15 has shown that such a range is not observed in a case where the short-circuit sections 22*a* and 22*b* and the ground sections 22*c* and 22*d* are provided. That is, it is confirmed by comparing the graph of FIG. 15 and the graph of FIG. 17 that the provision of the short-circuit sections 22*a* and 22*b* and the ground sections 22*c* and 22*d* allows suppressing a VSWR value to 2.5 or lower throughout the required band.

Note that, as described later, in a case where the antenna 2 is disposed parallel to an electric conductor plate 4 (see FIG. 18), the antenna 2 is electromagnetically and electrostatically coupled to the electric conductor plate 4. In this case, the antenna 2 can also be regarded a patch antenna.

[Way of Combining Antennas]

The following discusses, with reference to FIG. 18, a way of combining the three antennas 1 through 3 described above. FIG. 18 is a trihedral drawing illustrating a way of combining the three antennas 1 through 3. The three antennas 1 through 3 are designed on the assumption that the three antennas 1 through 3 are used near the electric conductor plate 4 in a state where the three antennas 1 through 3 are combined as illustrated in FIG. 18, (in FIG. 18, the electric conductor plate 4 is illustrated only in an elevation view and a side view and is omitted in a plan view). Note that with an integrated antenna device 100 (see FIG. 21) which will be described later as an example, a metal base 101 included in the integrated antenna device 100 and/or a roof of an automobile on which the integrated antenna device 100 is placed correspond(s) to the electric conductor plate 4.

The antenna 1 is disposed so that a main surface of the antenna 1 is perpendicular to a main surface of the electric conductor plate 4 as illustrated in FIG. 18. Further, the antenna 1 is bent so that an end surface of the antenna 1 forms a U like shape as illustrated in the plan view.

The antenna 2 is disposed so that a main surface of the antenna 2 is parallel to the main surface of the electric conductor plate 4 as illustrated in FIG. 18. At this time, in the plan view, the main surface of the antenna 2 is surrounded from three directions by the end surface of the antenna 1. Further, as illustrated in the elevation view and the side view, an end surface of the antenna 2 overlaps with an upper end (an end on a side opposite to an electric conductor plate 4 side) of the main surface of the antenna 1.

The antenna 3 is disposed so that a main surface of the antenna 3 is parallel to the main surface of the electric conductor plate 4 as illustrated in FIG. 18. At this time, in the plan view, the main surface of the antenna 3 is surrounded by the end surface of the antenna 1, and overlaps with the main surface of the antenna 2. Further, as illustrated in the elevation view and the side view, the antenna 3 is disposed so that an end surface of the antenna 3 is located above the upper end of the main surface of the antenna 1.

The first notable point of the combination illustrated in FIG. 18 is the employment of a configuration in which, when the main surface of the electric conductor plate 4 is a reference surface, (i) the antenna 1 is disposed so that the main surface of the antenna 1 is perpendicular to the reference surface and (ii) the antenna 2 is disposed so that the main surface of the antenna 2 is parallel to the reference surface and the end surface of the antenna 2 overlaps with the upper end of the main surface of the antenna 1. The configuration allows combining the antenna 1 with the antenna 2 by adding substantially no space for the antenna 2 with respect to a direction perpendicular to the reference surface.

Note that, although the configuration employed in FIG. 18 is such that the end surface of the antenna 2 overlaps with the upper end of the main surface of the antenna 1 in a lateral view, the present embodiment is not limited to this. That is, an effect similar to that obtained by the configuration illustrated in FIG. 18 can also be brought about by a configuration in which the end surface of the antenna 2 is located in a position lower than the upper end of the main surface of the antenna 1 and higher than the lower end of the main surface of the antenna 1 in the lateral view. In short, an effect similar to that obtained by the configuration illustrated in FIG. 18 can be brought about by any configuration in which the end surface of the antenna 2 overlaps with the main surface of the antenna 1 in the lateral view.

Note that in a case where the antenna 2 is, like an antenna for DAB, an antenna for receiving an electromagnetic wave transmitted from a terrestrial broadcasting station, it is most preferable to employ a configuration in which, as illustrated in FIG. 18, the end surface of the antenna 2 overlaps with the upper end of the main surface of the antenna 1 in the side view. This is because, in a case where the end surface of the antenna 2 is located in a position lower than the upper end of the main surface of the antenna 1 in the side view, an electromagnetic wave laterally coming is blocked by the antenna 1.

The second notable point of the combination illustrated in FIG. 18 is the employment of a configuration in which the antenna 1 is bent so that the end surface of the antenna 1 extends along an outer edge of the main surface of the antenna 2 when viewed from above. This configuration allows combining the antenna 2 with the antenna 1 by adding substantially no space for the antenna 1 with respect to a direction parallel to the reference surface.

Note that, although the configuration employed in FIG. 18 is such that the antenna 1 is bent at two positions so that the end surface of the antenna 1 extends along three sides of the main surface of the antenna 2 when viewed from above, the present embodiment is not limited to this. That is, an effect similar to that obtained by the configuration illustrated in FIG. 18 can also be brought about by a configuration in which the antenna 1 is bent at one (1) position so that the end surface of the antenna 1 extends along two sides of the main surface of the antenna 2 when viewed from above, or a configuration in which the antenna 1 is bent at four positions so that the end surface of the antenna 1 extends along four sides of the main surface of the antenna 2 when viewed from above.

The third notable point of the configuration illustrated in FIG. 18 is the employment of a configuration in which the antenna 3 is disposed so that the main surface of the antenna 3 is parallel to the reference surface. This makes it possible to suppress an increase in space in the direction perpendicular to the reference surface, which increase is caused when the antenna 3 is combined with the antennas 1 and 2, as compared with a case of employing a configuration in which the antenna 3 is disposed so that the main surface of the antenna 3 is perpendicular to the reference surface.

A configuration in which the antenna 2 for receiving a DAB wave is provided closer to the reference surface than the antenna 3 for receiving a GPS wave is advantageous for the following two reasons.

First, the standard electric field intensity of a GPS wave is approximately −130 dBm to −140 dBm, which is lower than the standard electric field intensity of a DAB wave. As such, in a case where attenuation is caused by a blocking effect of another planar antenna provided in a layer higher than a layer in which an antenna for receiving a GPS wave is provided, poor reception of the GPS wave is likely to occur. On the other hand, the standard electric field intensity of a DAB wave is approximately 60 dBm, which is higher than the standard electric field intensity of a GPS wave. As such, even in a case where attenuation is caused by a blocking effect of another planar antenna provided in a layer higher than a layer in which an antenna for receiving a DAB wave is provided, poor reception is unlikely to occur. Accordingly, in order to minimize the possibility of occurrence of poor reception, it is preferable that the antenna 3 for receiving a GPS wave having the low standard electric field intensity be provided in a layer higher than a layer in which the antenna 2 for receiving a DAB wave having the high standard electric field intensity is provided (that is, it is preferable that the antenna 3 be located further from the reference surface than the antenna 2 is).

Note that, as a matter of course, a design policy that a planar antenna for receiving an electromagnetic wave having a lower standard electric field intensity be provided in a layer higher than a layer in which a planar antenna for receiving an electromagnetic wave having a higher standard electric field intensity is provided is effective regardless of the number of planar antennas to be stacked.

Secondly, a GPS wave is an electromagnetic wave coming from the zenith direction. As such, in a case where attenuation is caused by a blocking effect of another planar antenna provided in a layer higher than a layer in which an antenna for receiving a GPS is provided, poor reception is likely to occur. On the other hand, a DAB wave is an electromagnetic wave coming from the horizontal direction. As such, even in a case where attenuation is caused by a blocking effect of another planar antenna provided in a layer higher than a layer in which an antenna for receiving a DAB wave is provided, poor reception is unlikely to occur. Accordingly, in order to minimize the possibility of occurrence of poor reception, it is preferable that the antenna 3 for receiving a GPS wave coming from the zenith direction be provided in a layer higher than a layer in which the antenna 2 for receiving a DAB wave coming from the horizontal direction is provided (that is, it is preferable that the antenna 3 be provided further from the reference surface than the antenna 2 is).

Note that, as a matter of course, a design policy that a planar antenna for receiving an electromagnetic wave coming from the zenith direction be provided in a highest layer is effective regardless of the number of planar antennas to be stacked.

From the viewpoint of efficient use of space, a configuration as illustrated in an elevation view of (b) of FIG. 19 in which the antenna 1 is provided in a middle layer between the antenna 2 and the antenna 3 is advantageous over a configuration as illustrated in an elevation view of (a) of FIG. 19 in which the antenna 1 is provided in a layer lower than a layer in which the antenna is provided. However, in a case where the latter configuration is employed, the antenna 1 cannot exhibit a desired performance, as explained below.

FIG. 20 is a graph showing a VSWR characteristic (indicated by a gray line) of the antenna 1 obtained in a case where the former configuration is employed, and a VSWR characteristic (indicated by a black line) of the antenna 1 obtained in a case where the latter configuration is employed. As mentioned above, the antenna 1 is expected to operate both in the low frequency-side required band (not lower than 761 MHz but not higher than 960 MHz) and the high-frequency side required band (not lower than 1710 MHz but not higher than 2130 MHz). However, in the case where the latter configuration is employed, a VSWR value exceeds −3 dB in a part of the high frequency-side required band, as shown by the graph of FIG. 20. This shows that the configuration in which the antenna 1 is provided in a layer lower than a layer in which the antenna 2 is provided is the best configuration which realizes both efficient use of space and a good VSWR characteristic of the antenna 1.

[Integrated Antenna]

Next, the following description discusses, with reference to FIG. 21, the integrated antenna device 100 in which the three antennas 1 through 3 are combined. FIG. 21 is an exploded perspective view illustrating the integrated antenna device 100.

The integrated antenna device 100 is a vehicle-mounted antenna device which can be mounted suitably on a roof of an automobile, and includes the metal base 101, a circuit board 102, a rubber base 103, a spacer 104, and a radome 105 as well as three the antenna 1 through 3, as illustrated in FIG. 21.

The metal base 101 is a rectangular plate member having rounded corners, and is made of aluminum. On an upper surface of the metal base 101, four spacers 101*a* are provided so as to be interposed between the upper surface of the metal base 101 and a lower surface of the antenna 2, thereby allowing the antenna 2 to be spaced apart from the metal base 101. In the present embodiment, a height of each of the spacers 101*a* is set to 5 mm. This causes the antenna 2 to be spaced apart from the metal base 101 by 5 mm.

The circuit board 102 is a rectangular plate member sandwiched between the metal base 101 described above and the rubber base 103 which will be described later. On the circuit board 102 provided are two amplifier circuits, one of which is for amplifying an electric signal generated by the antenna 2 for DAB, and the other of which is for amplifying an electric signal generated by the antenna 3 for GPS.

The rubber base 103 is a plate member having a shape substantially identical to that of the metal base 11, and is made of rubber. The rubber base 103 includes at its outer edge a skirt section protruding downward, and the metal base 101 described above is fitted in a space surrounded by the skirt section on an underside of the rubber base 103. Through holes are formed in the rubber base 103 so as to allow the spacers 101*a* provided on the upper surface of the metal base 101 to be passed through the through holes. This causes the spacers 101*a* provided on the upper surface of the metal base 101 to be exposed to an upper side of the rubber base 103 when the metal base 101 is fitted in the space on the underside of the resin base 103.

The spacer 104 is a plate member interposed between the antenna 2 and the antenna 3, and is made of molded resin. The spacer 104, by its thickness, causes the antenna 2 and the antenna 3 to be spaced apart from each other. In the present embodiment, the thickness of the spacer 104 is set to 5 mm. This causes the antenna 2 to be spaced apart from the antenna 3 by 5 mm.

The radome 105 is a dome-shaped member having a shape of a bottom of a ship, and has an outer edge fitted in the rubber base. This forms a space, sealed by the rubber base 103 and the radome 105, for containing the antennas 1 through 3. As long as the sealing is maintained, there is no possibility that the antennas 1 through 3 are exposed to rain in an outdoor environment. Further, the radome 105 is made of resin. This eliminates the possibility that an electric field intensity of an electromagnetic wave that has reached the antenna device 100 is attenuated by the radome 105.

The integrated antenna device 100 has mounted therein the three antennas 1 through 3. The configuration of each of the three antennas 1 through 3 and the way of combining the three antennas 1 through 3 are all as described above.

[Conclusion]

The Description describes at least the following invention.

That is, the Description describes an inverted F antenna including a ground plane, an antenna element, and a short-circuit section, which are provided in a two-dimensional surface, the antenna element having a linear shape, the antenna element including a branch which intersects with a coaxial cable extracted from the ground plane, the ground plane being provided in a region defined by the antenna element and a straight line which is parallel to the antenna element and passes through a tip of the branch.

According to the configuration, the provision of the branch creates a new electric current path in the antenna element, thereby causing a change in resonance frequency of the inverted F antenna. Further, since the branch intersects with the coaxial cable, an electromagnetic coupling is caused between the antenna element and an outer conductor of the coaxial cable and, accordingly, an input impedance of the inverted F antenna changes. That is, according to the configuration, by appropriately changing the shape, size, and number of the branch(s), it is possible to provide an inverted F antenna that operates in a required frequency band and has a reduced return loss in the required frequency band.

Moreover, according to the configuration, a size of the inverted F antenna with respect to a direction perpendicular to the antenna element in the two-dimensional surface can be limited to a length substantially equal to a sum of a width of the antenna element and a length of the branch. As such, in a case where the inverted F antenna is mounted in an integrated antenna device, a size of the integrated antenna device with respect to a direction perpendicular to a base of the integrated antenna device can be reduced by providing the inverted F antenna perpendicular to the base.

The Description also describes a dipole antenna including a first antenna element provided in a two-dimensional surface and having a linear shape and a second antenna element provided in the two-dimensional surface and having a spiral shape that circles around the first antenna element.

According to the configuration, the first antenna element and the second antenna element can be provided within a region having a required size, while a length required for causing the dipole antenna to operate in a required frequency band is secured for a sum of a length of the first antenna element and a length of the second antenna element. Accordingly, in a case where the dipole antenna is mounted in an integrated antenna device, a size of the integrated antenna device with respect to a direction parallel to a base of the integrated antenna device can be reduced by providing the dipole antenna parallel to the base.

It is preferable that the dipole antenna further include (i) a short-circuit section causing different points on the second antenna element to be short-circuited and (ii) a ground section grounding a point on an outermost circumference of the second antenna element.

The configuration makes it possible to provide a dipole antenna having such VSWRs that a range in which a VSWR value exceeds a prescribed value is not included in a required frequency band.

The Description further describes a loop antenna including (i) an antenna element having a shape that traces an ellipse and (ii) a short-circuit section provided inside the ellipse, the short-circuit section causing two points on the antenna element to be short-circuited.

According to the configuration, the provision of the short-circuit section creates a new electric current path in the antenna element, thereby causing a change in resonance frequency of the loop antenna. Further, the provision of the short-circuit section causes a change in input impedance of the loop antenna. That is, according to the configuration, by appropriately changing the shape and/or size of the short-circuit section(s), it is possible to provide a loop antenna that operates in a required frequency band and has a reduced return loss in the required frequency band.

Moreover, according to the configuration, the short-circuit section is provided inside the ellipse which is traced by the shape of the antenna element. As such, the provision of the short-circuit section does not cause an increase in size of the loop antenna. Accordingly, in a case where the loop antenna is mounted in an integrated antenna device, a size of the integrated antenna device with respect to a direction parallel to a base of the integrated antenna device can be reduced by providing the loop antenna parallel to the base.

Note that the "ellipse" denotes an ellipse in a broad sense which encompasses a circle, instead of an ellipse in a narrow sense which excludes a circle.

It is preferable that the loop antenna further include a passive element having an outer edge extending along an outer circumference of the antenna element.

According to the configuration, the provision of the passive element allows an input reflection coefficient in a required frequency band to be reduced without causing a change in resonance frequency. That is, the configuration makes it possible to provide an antenna having a further reduced return loss in a required frequency band.

The loop antenna preferably has a configuration in which (i) the antenna element is constituted by a loop section which has a shape that traces the ellipse and a pair of feed sections which extend from respective both ends, located in a twelve o'clock direction as viewed from a center of the ellipse, of the loop section to near the center of the ellipse, (ii) the short-circuit section is constituted by a pair of short-circuit sections, one of which extends from a tip of one of the pair of feed sections in a nine o'clock direction and the other of which extends from a tip of the other of the pair of feed sections in a three o'clock direction, (iii) the passive element is constituted by a first passive element and a second passive element, the first passive element including (a) a main section which is a planar conductor having an outer edge extending along an outer circumference of the loop section from a position located in a six o'clock direction to a position located in the nine o'clock direction as viewed from the center of the ellipse and (b) an extension section extending in the twelve o'clock direction from an end section, located in the nine o'clock direction as viewed from the center of the ellipse, of the main section, the second passive element including (a) a main section which is a planar conductor having an outer edge extending along the outer circumference of the antenna element from a position located in the twelve o'clock direction to a position located in the three o'clock direction as viewed from the center of the ellipse and (b) an extension section extending in the nine o'clock direction from an end section, located in the twelve o'clock direction as viewed from the center of the ellipse, of the main section, and (iv) a tip of the extension section of the first passive element and a tip of the extension section of the second passive element are capacitively-coupled to each other.

[Additional Matter]

The present invention is not limited to the above-described embodiments but allows various modifications within the scope of the claims. In other words, any embodiment derived from a combination of two or more technical means appropriately modified within the scope of the claims will also be included in the technical scope of the present invention.

The present invention is applicable to a wide range of loop antennas in general. For example, the present invention can be suitably utilized in the form of an antenna device mounted in a movable body or a mobile terminal, or in the form of an antenna mounted in the antenna device. Examples of the movable body encompass an automobile, a railway vehicle, a ship, a vessel, and the like. Examples of the mobile terminal encompass a mobile phone terminal, a PDA (Personal Digital Assistance), a tablet PC (Personal Computer), and the like.

REFERENCE SIGNS LIST

1 ANTENNA (FOR 3G/LTE, INVERTED F ANTENNA)
11 GROUND PLANE
12 ANTENNA ELEMENT
**12*d*** BRANCH
13 SHORT-CIRCUIT SECTION
2 ANTENNA (FOR DAB, DIPOLE ANTENNA)
21 ANTENNA ELEMENT
22 ANTENNA ELEMENT
**22*a*1** SHORT-CIRCUIT SECTION
**22*a*2** SHORT-CIRCUIT SECTION
**22*b*1** GROUND SECTION
**22*b*2** GROUND SECTION
3 ANTENNA (FOR GPS, LOOP ANTENNA)
31 ANTENNA ELEMENT
**32*a*** SHORT-CIRCUIT SECTION
**32*b*** SHORT-CIRCUIT SECTION
33 PASSIVE ELEMENT
100 ANTENNA DEVICE (VEHICLE-MOUNTED)
101 METAL BASE
102 CIRCUIT BOARD
103 RUBBER BASE
104 SPACER
105 RADOME

The invention claimed is:

1. A loop antenna comprising an antenna element having a shape that traces a closed curve, the antenna element including (i) a first projection section which projects from one of two end sections of the antenna element toward an inside of the closed curve and (ii) a second projection section which projects from the other of the two end sections of the antenna element toward the inside of the closed curve, each of the first projection section and the second projection section including a feed point, wherein:

where a direction in which both ends of the antenna element are located as viewed from a center of the closed curve is a six o'clock direction, the first projection section is constituted by a first linear section and a second linear section, the first linear section extending in a twelve o'clock direction from a starting end section, which is one of the two end sections of the antenna element which one is a starting point of a line obtained by tracing the closed curve clockwise, the second linear section extending in a three o'clock direction from an end section, located in the twelve o'clock direction, of the first linear section;

the second projection section is constituted by a third linear section and a fourth linear section, the third linear section extending in the twelve o'clock direction from a terminus end section, which is one of the two end sections of the antenna element which one is an ending point of the line obtained by tracing the closed curve clockwise, the fourth linear section extending in a nine o'clock direction from an end section, located in the twelve o'clock direction, of the third linear section; and the second linear section of the first projection section and the fourth linear section of the second projection section each including the feed point.

2. A loop antenna as set forth in claim 1, further comprising a short-circuit section provided inside the closed curve, the short-circuit section causing two points on the antenna element to be short-circuited, where a direction in which the both ends of the antenna element are located as viewed from the center of the closed curve is a six o'clock direction, the short-circuit section causing the second projection section and a point, provided in a three o'clock direction as viewed from the center of the closed curve, on the antenna element to be short-circuited, the second projection section provided in a terminus end section which is one of the two end sections of the antenna element which one is an ending point of a line obtained by tracing the closed curve clockwise.

3. A loop antenna as set forth in claim 2, further comprising a passive element having an outer edge extending along an outer circumference of the antenna element from a position located in the three o'clock direction to a position located in the six o'clock direction as viewed from the center of the closed curve.

4. The loop antenna as set forth in claim 1, wherein the closed curve is an ellipse.

5. A loop antenna comprising an antenna element constituted by (i) a loop section which has a shape that traces a closed curve and (ii) a pair of feed sections which extend from respective both ends of the loop section to near a center of the closed curve, a tip of each of the pair of feed sections including a feed point, wherein:

a tip of one of the pair of feed sections includes a projection section which projects toward the other of the pair of feed sections; and the tip of the other of the pair of feed sections is bent along the projection section.

6. A loop antenna as set forth in claim 5, further comprising a short-circuit section provided inside the closed curve, the short-circuit section causing two points on the antenna element to be short-circuited, where (i) a direction in which both ends of the loop section are located as viewed from the center of the closed curve is a twelve o'clock direction and (ii) one of two end sections of the antenna element which one is a starting point of a line obtained by tracing the closed curve clockwise is a starting end section, the short-circuit section causing a tip of one of the pair of feed sections and a point on the antenna element to be short-circuited, the one of the pair of feed sections extending from the starting end section of the antenna element, the point being located in a three o'clock direction as viewed from the center of the closed curve.

7. A loop antenna as set forth in claim 6, further comprising a passive element including (i) a main section which is a planar conductor having an outer edge extending along an outer circumference of the antenna element from a position located in the twelve o'clock direction to a position located in the three o'clock direction as viewed from the center of the closed curve and (ii) an extension section extending in a nine o'clock direction from an end section, located in the twelve o'clock direction as viewed from the center of the closed curve, of the main section.

8. A loop antenna as set forth in claim 7, further comprising:

another passive element including (i) a main section which is a planar conductor having an outer edge extending along the outer circumference of the loop section from a position located in a six o'clock direction to a position located in the nine o'clock direction as viewed from the center of the closed curve and (ii) an extension section extending in the twelve o'clock direction from an end section, located in the nine o'clock direction as viewed from the center of the closed curve, of the main section, a tip of the extension section of the passive element and a tip of the extension section of the another passive element being capacitively-coupled to each other.

9. A loop antenna as set forth in claim 8, further comprising another short-circuit section, where one of the two end sections of the antenna element which one is an ending point of a line obtained by tracing the closed curve clockwise is a terminus end section, the another short-circuit section causing a tip of one of the pair of feed sections and a point on the antenna element to be short-circuited, the one of the pair of feed sections extending from the terminus end section of the antenna element, the point being located in the nine o'clock direction as viewed from the center of the closed curve.

10. The loop antenna as set forth in claim 5, wherein the closed curve is an ellipse.

11. The loop antenna as set forth in claim 5, wherein the antenna element has a meander shape.

12. A loop antenna comprising:

an antenna element constituted by (i) a loop section which has a shape that traces a closed curve and (ii) a pair of feed sections which extend from respective both ends of the loop section to near a center of the closed curve, a tip of each of the pair of feed sections including a feed point; and a short-circuit section provided inside the closed curve, the short-circuit section causing two points on the antenna element to be short-circuited, where (i) a direction in which both ends of the loop section are located as viewed from the center of the closed curve is a twelve o'clock direction and (ii) one of two end sections of the antenna element which one is a starting point of a line obtained by tracing the closed curve clockwise is a starting end section, the short-circuit section causing a tip of one of the pair of feed sections and a point on the antenna element to be short-circuited, the one of the pair of feed sections extending from the starting end section of the antenna element, the point being located in a three o'clock direction as viewed from the center of the closed curve.

* * * * *